US007672610B2

(12) United States Patent
Causey et al.

(10) Patent No.: US 7,672,610 B2
(45) Date of Patent: Mar. 2, 2010

(54) SYSTEMS AND METHODS FOR REMANUFACTURING IMAGING COMPONENTS

(75) Inventors: Anthony D. Causey, Fuquay Varina, NC (US); Lawrence Dale Lewis, Sanford, NC (US); Matthew J. Morton, Holly Springs, NC (US); Lynton R. Burchette, Sanford, NC (US); William E. Thacker, III, Sanford, NC (US)

(73) Assignee: Static Control Components, Inc., Sanford, NC (US)

( * ) Notice: Subject to any disclaimer, the term of this patent is extended or adjusted under 35 U.S.C. 154(b) by 198 days.

(21) Appl. No.: 11/893,080

(22) Filed: Aug. 14, 2007

(65) Prior Publication Data

US 2007/0297828 A1 Dec. 27, 2007

Related U.S. Application Data

(63) Continuation-in-part of application No. 11/254,136, filed on Oct. 19, 2005, now Pat. No. 7,424,245.

(51) Int. Cl.
*G03G 15/00* (2006.01)
*G03G 15/08* (2006.01)

(52) U.S. Cl. ..... 399/109; 399/12; 399/262

(58) Field of Classification Search ..... 399/109, 399/119, 120, 262, 107, 110, 111, 12, 90
See application file for complete search history.

(56) References Cited

U.S. PATENT DOCUMENTS 5,261,326 A 11/1993 Michlin
5,476,818 A 12/1995 Yanof
5,729,795 A 3/1998 Kavolius et al.
5,870,654 A 2/1999 Sato et al.
6,097,908 A 8/2000 Uchiyama et al.
6,166,916 A 12/2000 Jelinger
6,219,506 B1 4/2001 Morinaga et al.
6,227,638 B1 5/2001 Childers
6,588,871 B2 * 7/2003 Studholme et al. ..... 399/12 X
6,615,008 B2 9/2003 Higeta et al.
6,654,577 B1 11/2003 Hooper
6,721,520 B2 4/2004 Higeta et al.
6,788,908 B2 9/2004 Sekine
6,801,734 B1 10/2004 Jones et al.
6,904,248 B2 6/2005 Daniels
6,941,092 B2 9/2005 Yokoi
2002/0025186 A1 2/2002 Karakama et al.

(Continued)

FOREIGN PATENT DOCUMENTS

EP 0939357 A2 9/1999

(Continued)

*Primary Examiner*—Sophia S Chen

(57) ABSTRACT

Techniques for attaching a replacement chip to an imaging cartridge are described. An exemplary method of modifying a toner hopper assembly for use in a toner cartridge consists of providing the toner hopper assembly having a generally cylindrical shape and an at least partially non-functioning electronic chip with electrical contacts disposed in an end-plate section of the generally cylindrical shape. The method further modifies the toner hopper assembly by affixing a replacement chip to the toner hopper assembly to form a modified toner hopper assembly. The replacement chip includes replacement electrical contacts which allow the replacement chip to communicate with a printer when the modified toner cartridge is installed in the printer.

23 Claims, 33 Drawing Sheets

U.S. PATENT DOCUMENTS

2002/0034398 A1 3/2002 Higeta et al.
2002/0106213 A1 8/2002 Higeta et al.
2002/0172528 A1 11/2002 Sekine
2003/0123887 A1* 7/2003 Imes et al. ..... 399/24
2004/0091282 A1 5/2004 Yokoi
2004/0114959 A1 6/2004 Daniels
2004/0170445 A1 9/2004 Moore et al.
2004/0228641 A1* 11/2004 Rommelmann et al. ..... 399/12
2005/0036801 A1 2/2005 Burchette
2005/0135836 A1 6/2005 Rogers et al.
2005/0196180 A1* 9/2005 Harumoto ..... 399/12
2006/0153578 A1* 7/2006 May ..... 399/12

FOREIGN PATENT DOCUMENTS

GB 2389196 A 12/2003

* cited by examiner

SYSTEMS AND METHODS FOR REMANUFACTURING IMAGING COMPONENTS

CROSS REFERENCE TO RELATED APPLICATIONS

This application is a continuation-in-part of application Ser. No. 11/254,136 filed Oct. 19, 2005 entitled "Systems and Methods for Remanufacturing Imaging Components" the contents of which are relied upon and incorporated herein by reference in their entirety, and the benefit of priority under 35 U.S.C. 120 is hereby claimed.

BACKGROUND

The present invention generally relates to manufacturing, remanufacturing or repairing replaceable imaging components, and more particularly to apparatus and techniques for modifying a replaceable imaging cartridge to operate with a replacement electronic circuit.

In the imaging industry, there is a growing market for the remanufacture and refurbishing of various types of replaceable imaging cartridges such as toner cartridges, drum cartridges, inkjet cartridges, and the like. These imaging cartridges are used in imaging devices such as laser printers, xerographic copiers, inkjet printers, facsimile machines and the like, for example. Imaging cartridges, once spent, are unusable for their originally intended purpose. Without a refurbishing process these cartridges would simply be discarded, even though the cartridge itself may still have potential life. As a result, techniques have been developed specifically to address this issue. These processes may entail, for example, the disassembly of the various structures of the cartridge, replacing toner or ink, cleaning, adjusting or replacing any worn components and reassembling the imaging cartridge.

Some toner cartridges may include a chip having a memory device which is used to store data related to the cartridge or the imaging device, such as a printer, for example. The imaging device may communicate with the chip using a direct contact method or a broadcast technique utilizing radio frequency (RF) communication. This chip is typically mounted in a location, such as a slot, on the cartridge to allow for proper communication between the printer and the toner cartridge when the cartridge is installed in the printer. When the toner cartridge is being remanufactured, as described above, the chip provided by the original equipment manufacturer (OEM), such as Hewlett-Packard or Lexmark, may need to be replaced by a compatible chip developed by a third party. Such a replacement chip may be larger and not have the same physical form factor as the OEM chip and thus may not fit into the slot on the toner cartridge. Thus, it would be desirable to provide techniques for solving this problem and allowing a replacement chip having a different form factor be installed on the toner cartridge by, for example, modifying the toner cartridge to accept the replacement chip.

SUMMARY

In one aspect of the present invention a method of modifying a toner hopper assembly for use in a toner cartridge is disclosed. The method provides the toner hopper assembly having a generally cylindrical shape and an at least partially non-functioning electronic chip with electrical contacts disposed in an endplate section of the generally cylindrical shape. The method further modifies the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer.

In another aspect of the present invention, a method of modifying an imaging cartridge includes providing the toner hopper assembly having a generally cylindrical shape and an at least partially non-functioning electronic chip with electrical contacts disposed in an endplate section of the generally cylindrical shape. The method further modifies the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer and the electrical contacts of the replacement chip are placed over the electrical contacts of the at least partially non-functioning electronic chip.

In a further aspect of the present invention, a method of modifying an imaging cartridge includes providing the toner hopper assembly having a generally cylindrical shape and an at least partially non-functioning electronic chip with electrical contacts disposed in an endplate section of the generally cylindrical shape. The method further modifies the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer. The method also includes removing a portion of the at least partially non-functioning electronic chip through a contact window in the toner hopper assembly and the replacement chip is placed over the contact window.

In a further aspect of the present invention, a method of modifying an imaging cartridge includes providing the toner hopper assembly having a generally cylindrical shape and an at least partially non-functioning electronic chip with electrical contacts disposed in an endplate section of the generally cylindrical shape. The method further modifies the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer. The method also includes forming a hole in the endplate, wherein electrical components of the replacement chip are positioned extending into the hole when the replacement chip is positioned over the at least partially non-functioning chip.

In yet another aspect of the present invention, a method of modifying an imaging cartridge includes providing the toner hopper assembly having a generally cylindrical shape and an at least partially non-functioning electronic chip with electrical contacts disposed in an endplate section of the generally cylindrical shape. The method further modifies the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer. The method also includes removing a section of the endplate and the contacts of the replacement chip are placed over the contacts of the at least partially non-functioning chip In yet another aspect of the present invention, a method of modifying an imaging cartridge includes providing the toner hopper assembly having a generally cylindrical shape and an at least partially non-functioning electronic chip with electrical contacts disposed in an endplate section of the generally cylindrical shape. The method further modifies the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer. The method also includes removing a section of the endplate and a portion of the at least partially non-functioning electronic chip and the replacement chip is placed where the portion of the at least partially non-functioning chip was removed.

A more complete understanding of the present invention, as well as further features and advantages of the invention, will be apparent from the following detailed description and the accompanying drawings.

DETAILED DESCRIPTION

The following detailed description of preferred embodiments refers to the accompanying drawings which illustrate specific embodiments of the invention. In the discussion that follows, specific systems and techniques for repairing, manufacturing or remanufacturing a toner cartridge, such as an HP 2600 toner cartridge, are disclosed. Other embodiments having different structures and operations for the repair, remanufacture and operation of other types of replaceable imaging components and for various types of imaging devices, such as laser printers, inkjet printers, copiers, facsimile machines and the like, do not depart from the scope of the present invention.

Figure 1:
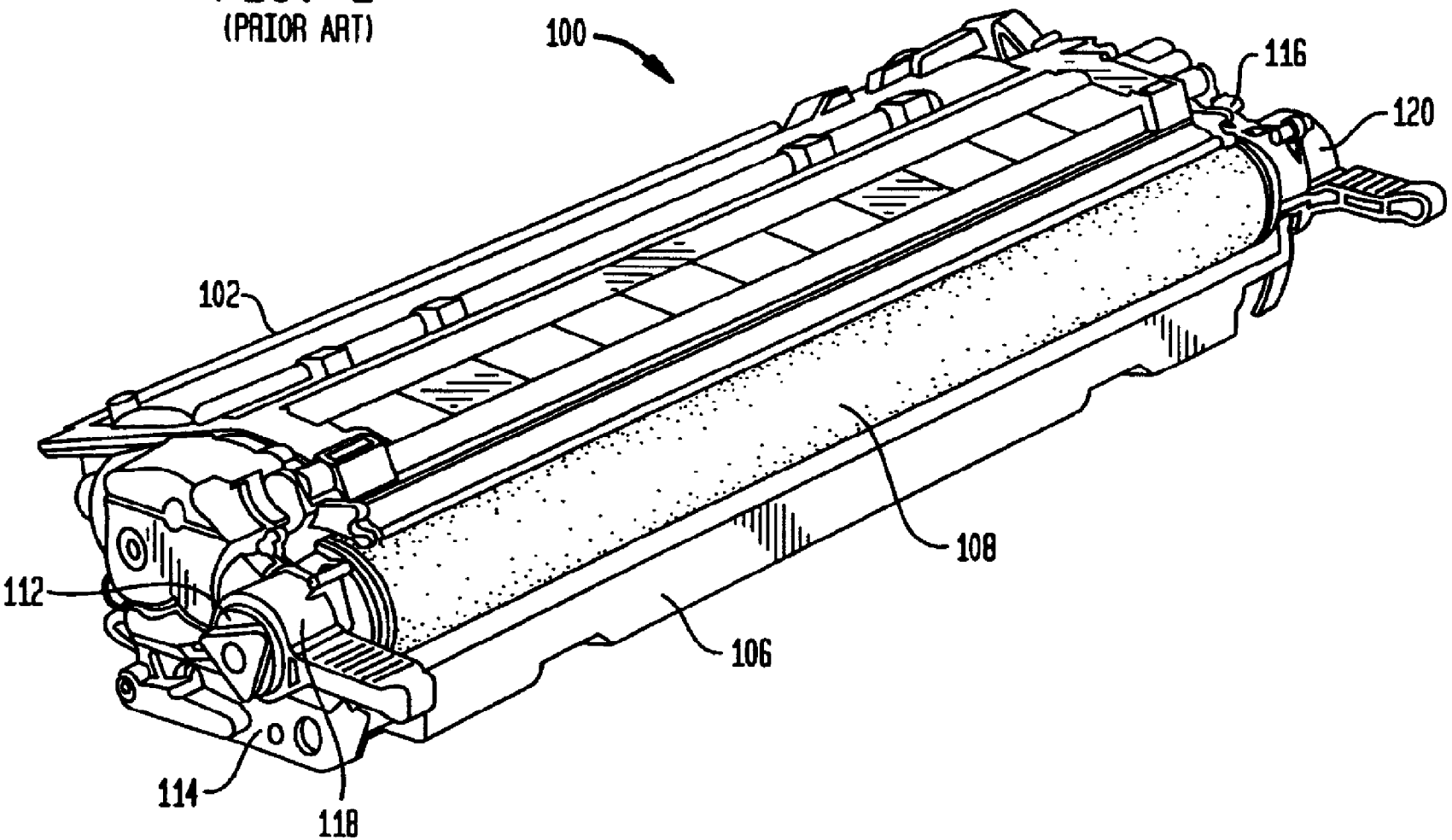
FIG. 1 (PRIOR ART)
FIG. 1 shows a perspective view of the drive side end of a prior art toner cartridge.
Figure 2:
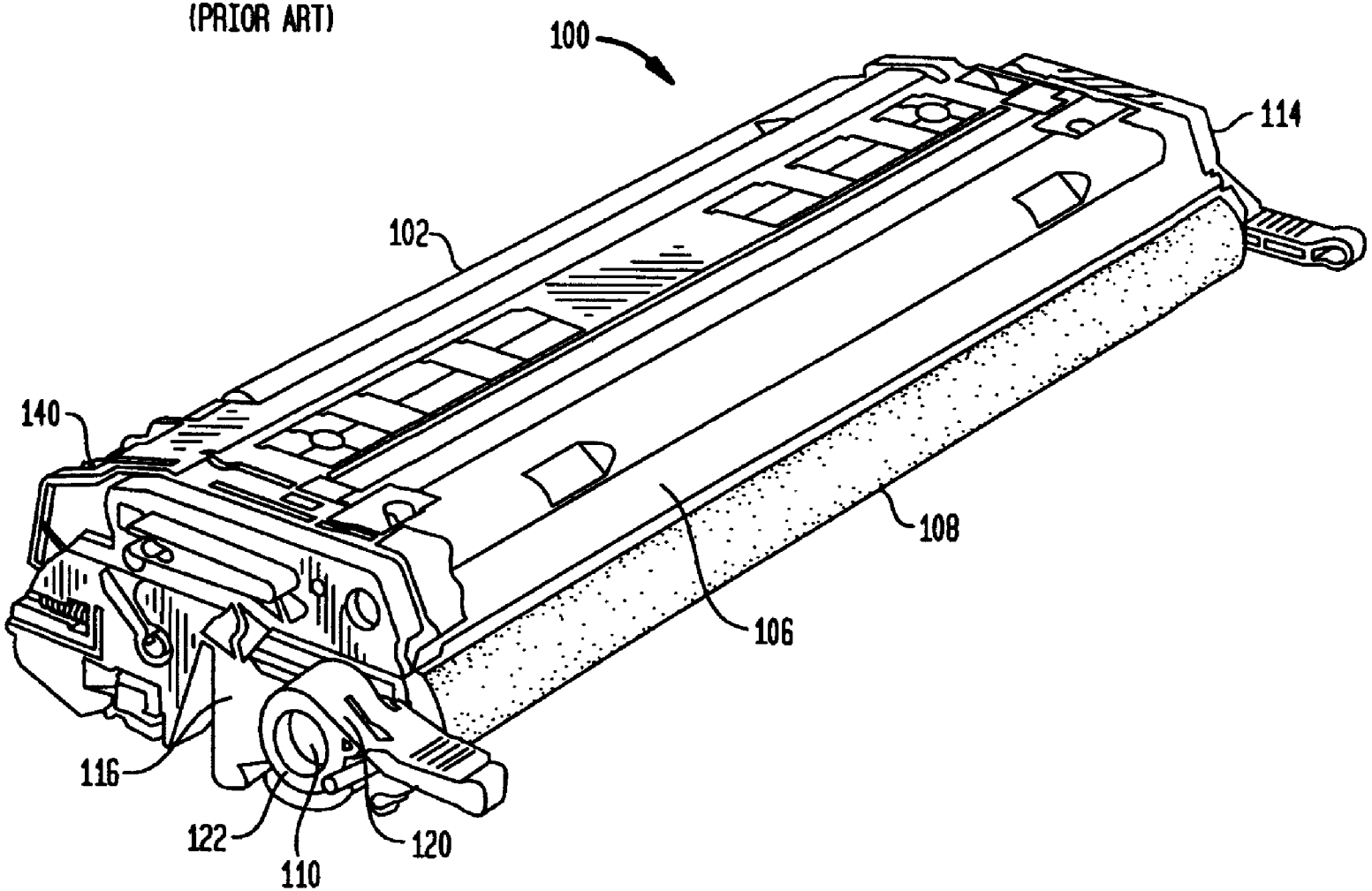
FIG. 2 (PRIOR ART)
FIG. 2 shows a perspective view of the non-drive side end view of a prior art toner cartridge.
Figure 3:
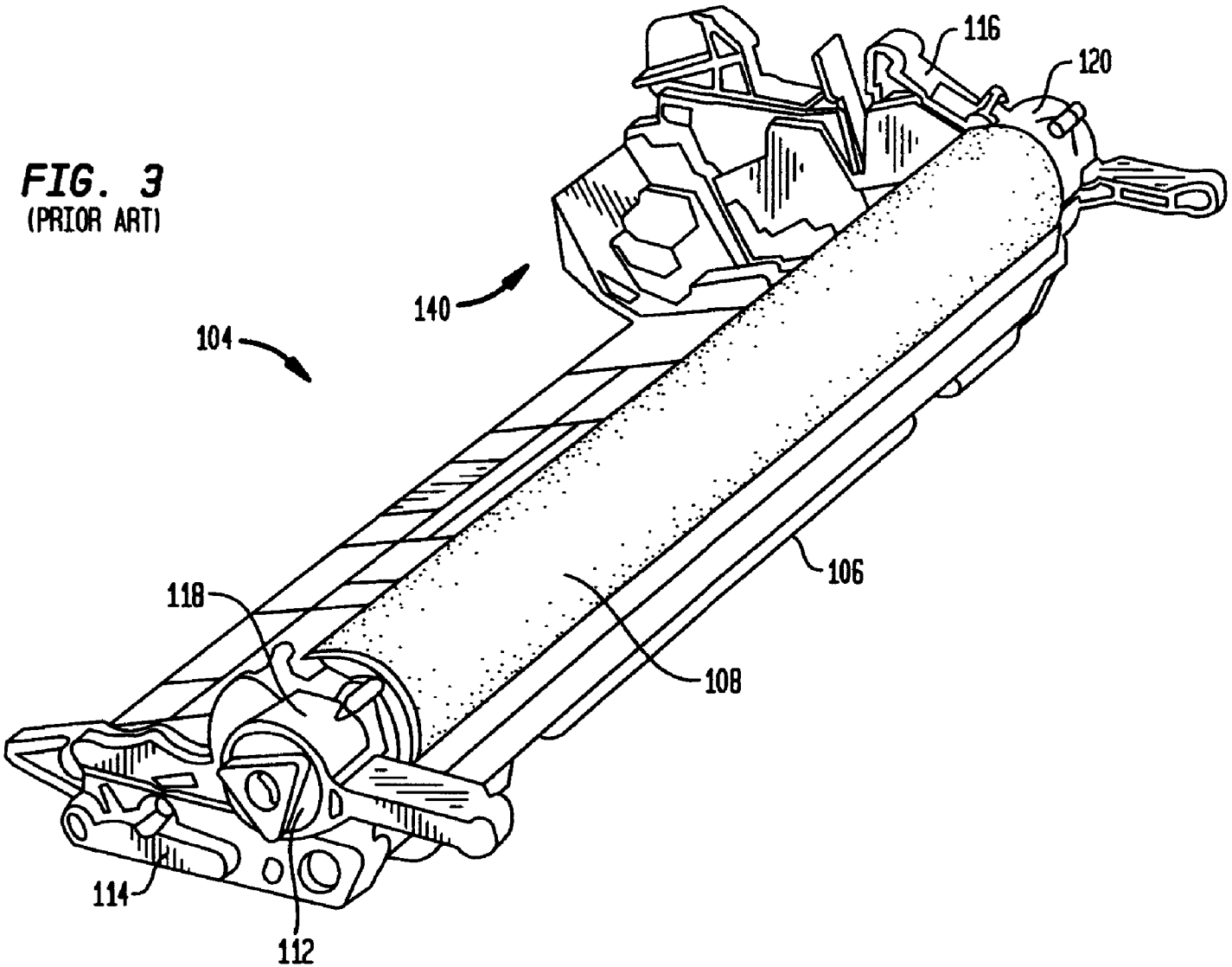
FIG. 3 (PRIOR ART)
FIGS. 3 and 4 show perspective views of a waste bin assembly.
Figure 4:
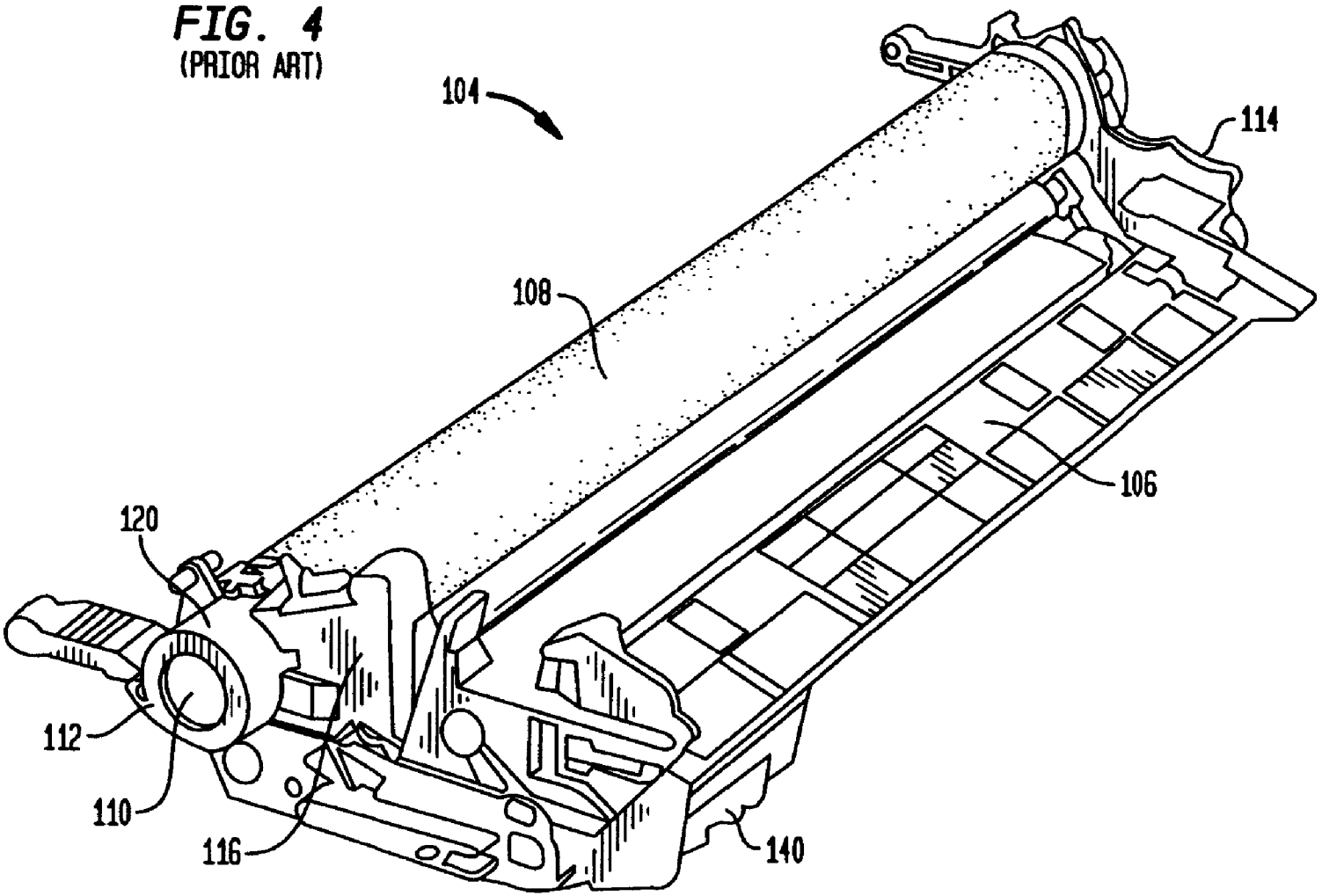
FIG. 4 (PRIOR ART)

FIGS. 1 and 2 show perspective views of a prior art toner cartridge 100. The toner cartridge 100 includes, among other components, a toner hopper assembly 102 and a waste bin assembly 104. FIGS. 3 and 4 show perspective views of the waste bin assembly 104 after separation from the toner cartridge 100. The waste bin assembly 104 includes a waste bin 106, an organic photo conductor (OPC) drum 108, and a chip holding structure 140, described in greater detail below. The OPC drum 108 comprises a cylindrical aluminum tube having first and second hubs 110 and 112, with each hub 110 and 112 extending from an end of the OPC drum 108. The OPC drum 108 is held in place by a drive side end cap 114 and a non-drive side end cap 116 which include OPC retaining members 118 and 120, respectively. The OPC retaining members 118 and 120 each include cylindrical openings which engage and hold the ends of the hubs 110 and 112 during the rotation of the OPC drum 108. The cylindrical opening of the OPC retaining member 120 is narrowed at the end by a flange 122.

Figure 5:
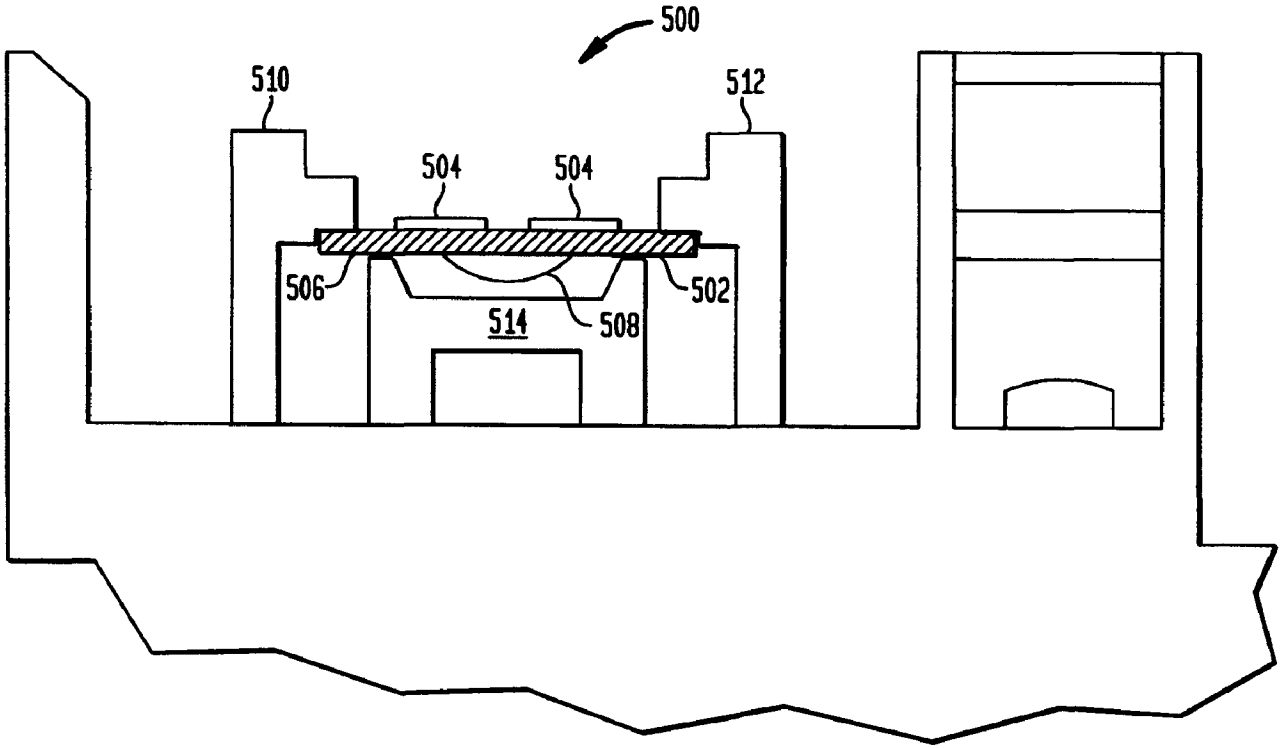
FIG. 5 PRIOR ART
FIG. 5 shows a cross-sectional view of a chip holding structure of a prior art toner cartridge.

FIG. 5 shows a cross-sectional view of a chip holding structure 500 of a prior art toner cartridge holding an OEM chip 502. The OEM chip 502 may include electrical contacts 504 on one side of a printed circuit board (PCB) 506 for engagement with the printer and circuitry 508 including a memory element on the opposing side. Plastic flanges 510 and 512 hold the OEM chip from the top and the sides while support member 514 supports the bottom of the chip 502. The support member 514 and the flanges 510 and 512 form a slot in which the chip 502 is inserted for attachment to the toner cartridge.

A replacement chip may be physically larger than the OEM chip 502 due to the inclusion of a microcontroller unit (MCU) or a system on a chip (SOC) and thus not fit into the slot housing the OEM chip. The present invention provides techniques for solving this problem and allowing a replacement chip having a different form factor be installed on the toner cartridge by, for example, modifying the toner cartridge to accept the replacement chip.

Figure 6:
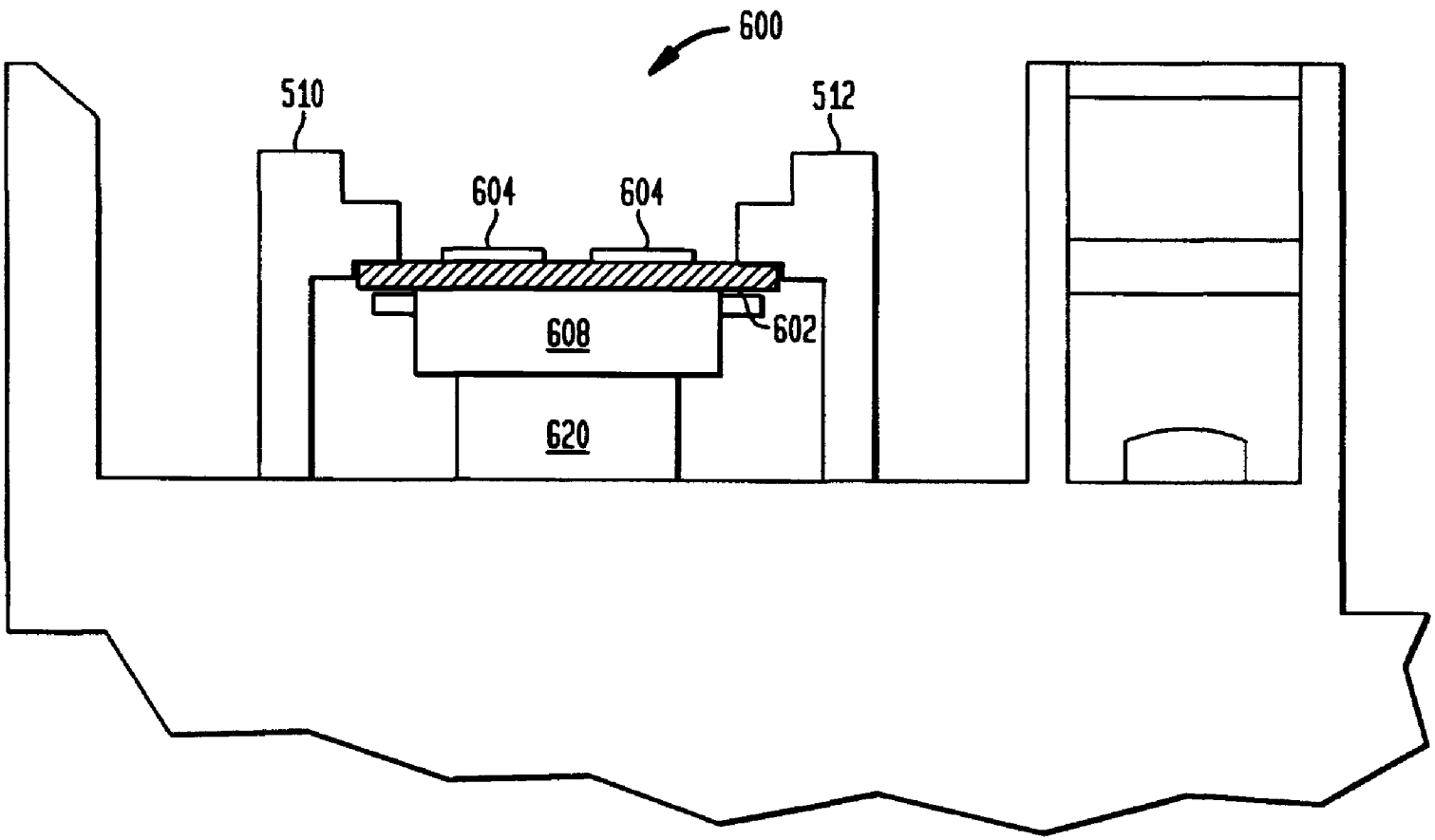
FIG. 6 shows a cross-sectional view of a modified chip holding structure in accordance with the present invention.
Figure 6A:
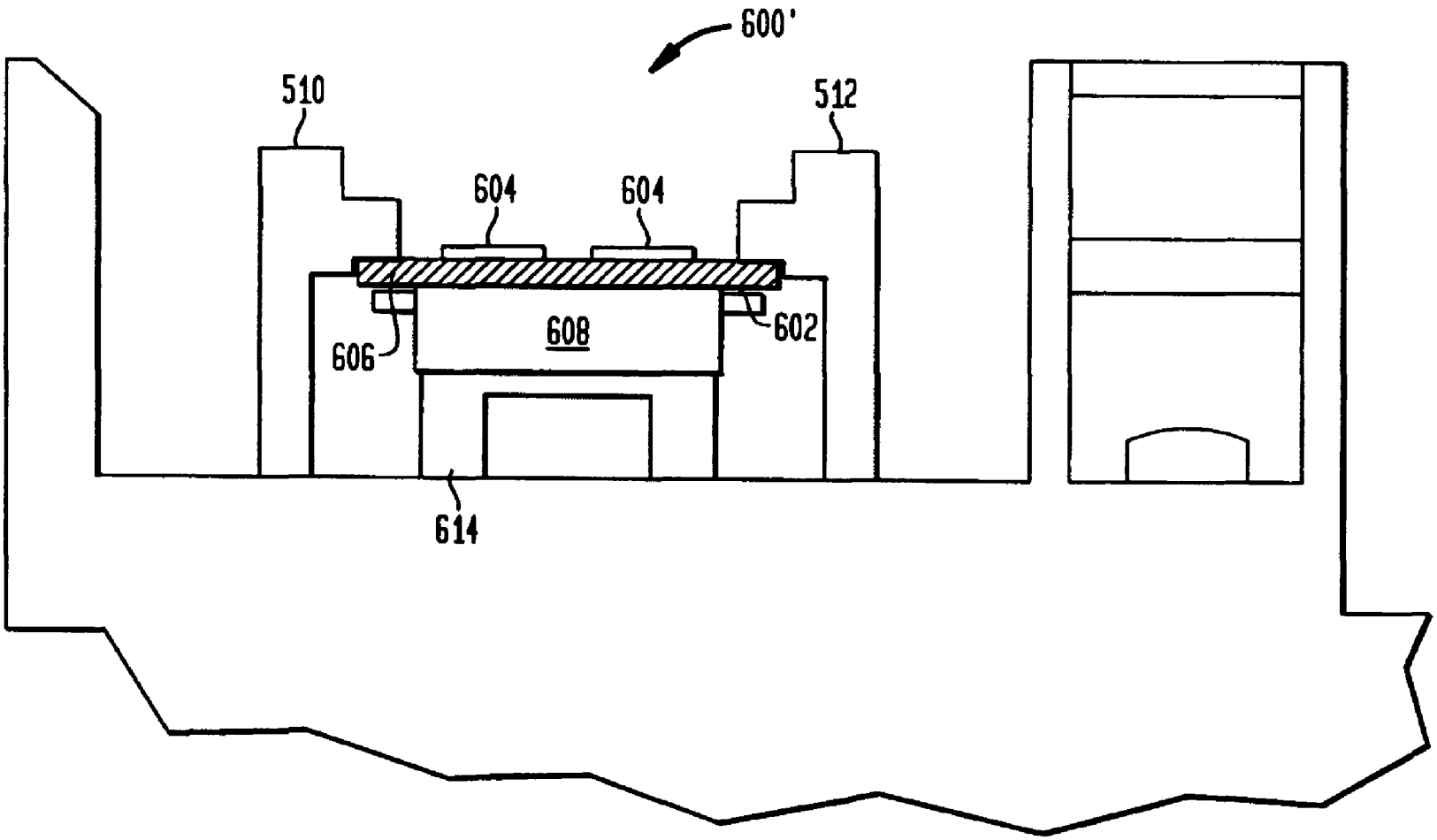
FIG. 6A shows a cross-sectional view of a modified chip holding structure in accordance with another aspect of the present invention.

FIG. 6 shows a cross-sectional view of a modified chip holding structure 600 holding a replacement chip 602 in accordance with one aspect of the present invention. The replacement chip 602 may comprise contacts 604 on one side of a PCB 606 communicatively connected to a processing unit 608, such as a microcontroller, for example. Due to the size of the processing unit 608 or other components, the replacement chip 602 has a greater thickness than the chip 502 and will not fit in the chip holding structure 500. As shown in FIG. 6, the support member 514 (shown in FIG. 5) has been removed to allow the larger replacement chip 602 to be installed in the slot on the toner cartridge. The support member 514 may be removed by cutting, filing or some other suitable technique. The replacement chip 602 may be held in place by an adhesive which adheres the PCB 606 to the flanges 510 and 512, or some other suitable technique. Optionally, the replacement chip may be held in place by a replacement support member 620 (smaller than the support member 514) shaped to the appropriate size for supporting the larger replacement chip 602 and attached to the toner cartridge in the general area where support member 514 was removed. The support member 620 may comprise many suitable materials, including plastic and adhesive, for example. In another aspect of the present invention, as shown in the modified chip holding structure 600' of FIG. 6A, only a portion of the support member 514 is removed to form a supporting structure 614 sized to support the bottom of the replacement chip 602. Other techniques may also be utilized to hold the replacement chip in the slot of the modified toner cartridge.

Figure 7:
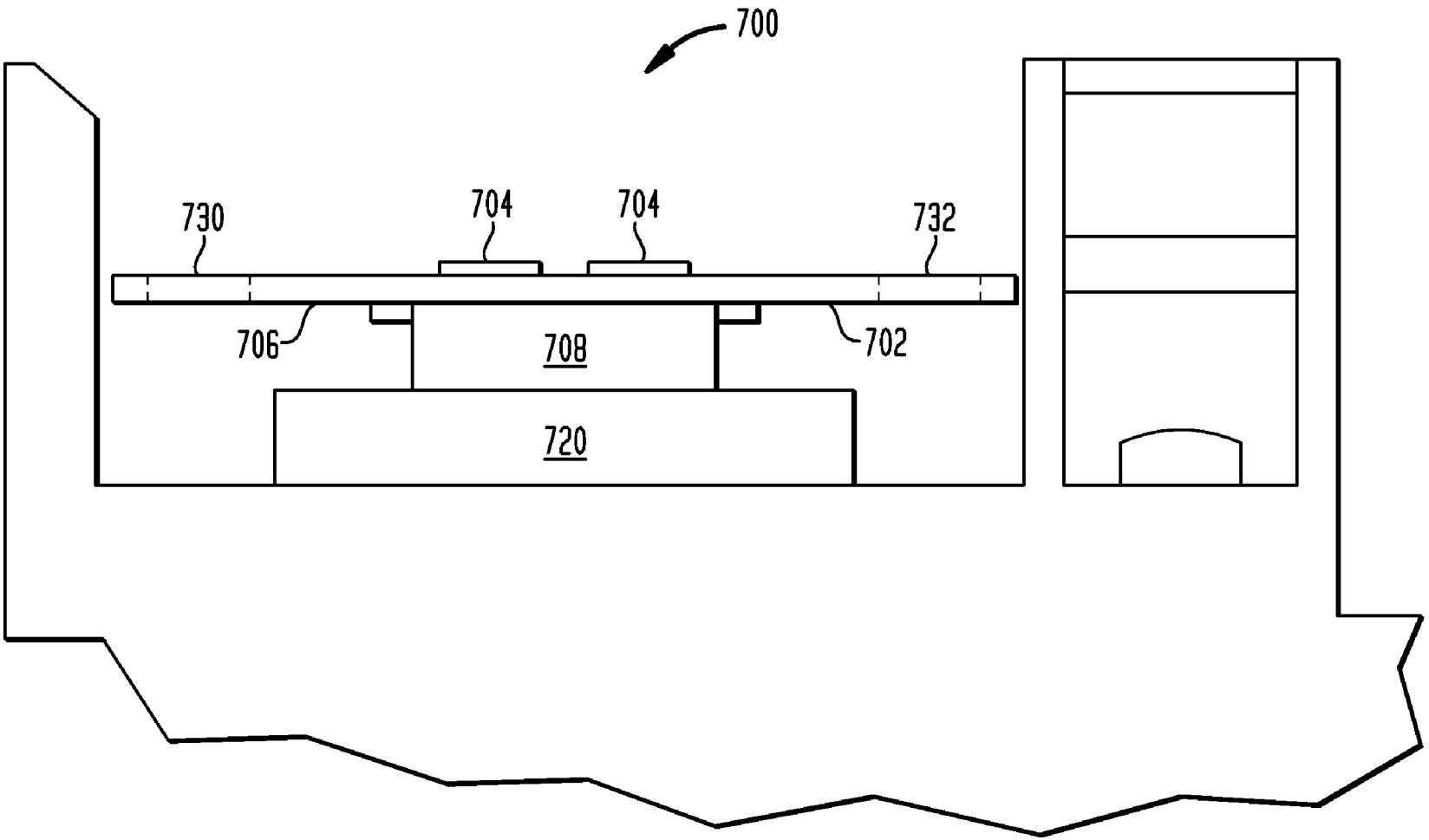
FIG. 7 shows a cross-sectional view of a new chip holding structure in accordance with the present invention.

FIG. 7 shows a cross-sectional view of a new chip holding structure 700 holding a replacement chip 702 in accordance with one aspect of the present invention. The replacement chip 702 may comprise contacts 704 on one side of a PCB 706 communicatively connected to a processing unit 708, such as a microcontroller, for example. Due to the size of the processing unit 708 or other components, the replacement chip 702 has a greater thickness and/or greater width than the chip 502 and will not fit in the chip holding structure 500. As shown in FIG. 7, the support member 514 and the flanges 510 and 512 have been removed to allow the larger replacement chip 702 to be installed in the toner cartridge. The support member 514 and the flanges 510 and 512 may be removed by cutting, filing or some other suitable technique. The replacement chip 702 may be held in place by one or more attachment members, such as member 720, shaped to the appropriate size for supporting the larger replacement chip 702 and attached to the toner cartridge, or some other suitable technique. The one or more attachment members 720 form the new chip holding structure 700. The member 720 may comprise many suitable materials, including plastic and adhesive, for example. The PCB 706 may include holes 730 and 732 for printer posts to pass through when the toner cartridge is installed in the printer. In another aspect of the present invention, only a portion of the support member 514 and the flanges 510 and 512 are removed to form a supporting structure sized to support the bottom of the replacement chip 702. Other techniques may also be utilized to hold the replacement chip in the slot of the modified toner cartridge. The processing circuitry 708 may be attached to either side of the PCB 706.

Figure 8:
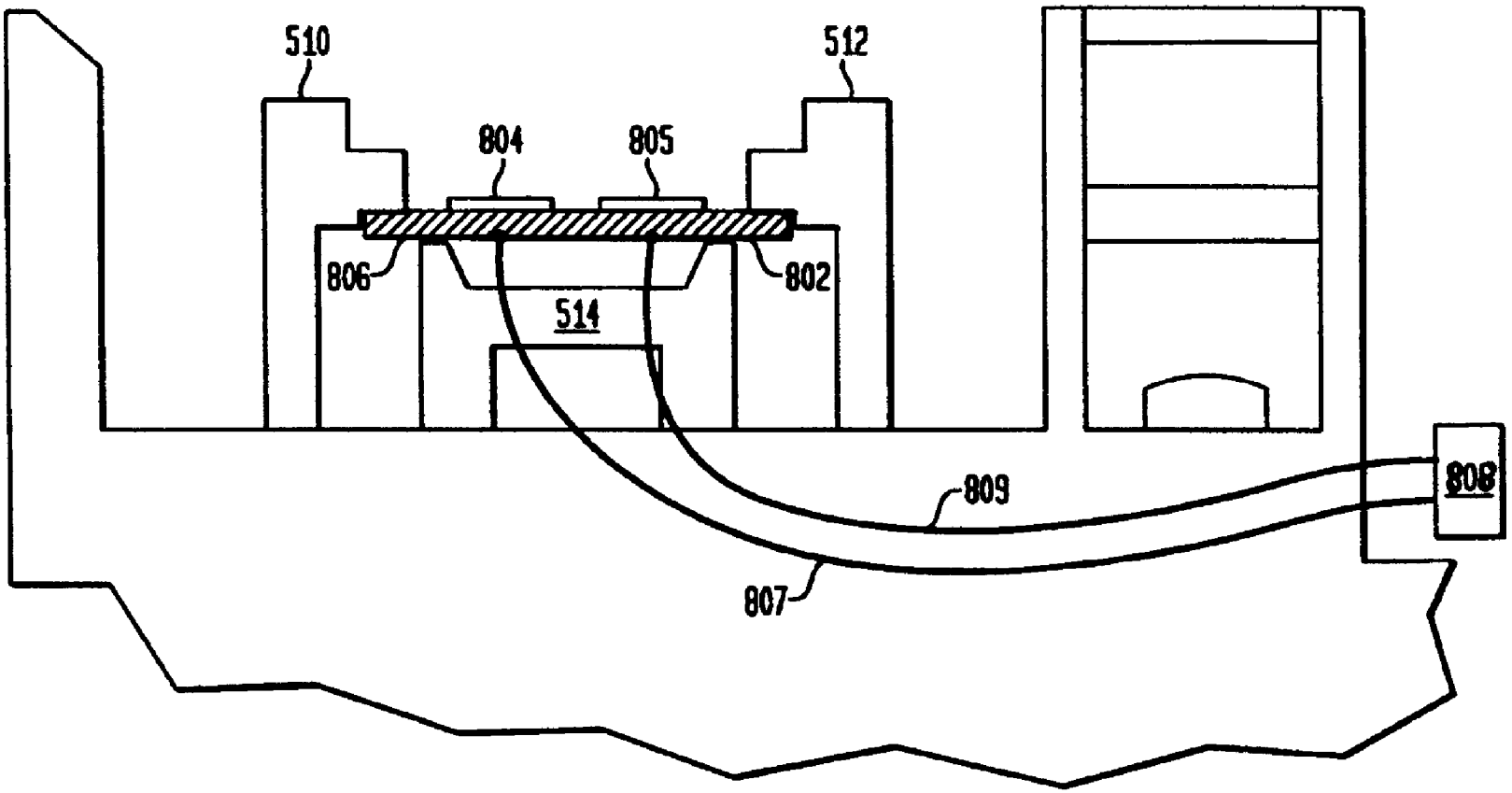
FIG. 8 shows a cross-sectional view of a chip holding structure holding a replacement contact element in accordance with the present invention.

In an alternate embodiment of the present invention, a replacement chip may be installed in the toner cartridge without making modifications to the chip holding structure 500. As shown in FIG. 8, a replacement contact element 802 may be installed in the chip holding structure 500. The replacement contact element 802 may comprise contacts 804 and 805 on one side of a PCB 806 communicatively connected to wires 807 and 809, respectively. This replacement contact element 802 preferably does not include a processing unit 808. The processing unit 808 may be attached to the toner cartridge in another location and connected to the contacts 804 and 805 through the wires 807 and 809. These wires 807 and 809 may be secured to the toner cartridge with tape or other appropriate means.

In another aspect of the present invention, either a portion of the waste bin assembly or the entire waste bin assembly may be replaced with a new waste bin assembly having the appropriate sized slot for the replacement chip. In one aspect of the present invention, the modifications to the toner cartridge may be accomplished with conventional cutting tools and a jig.

Figure 9:
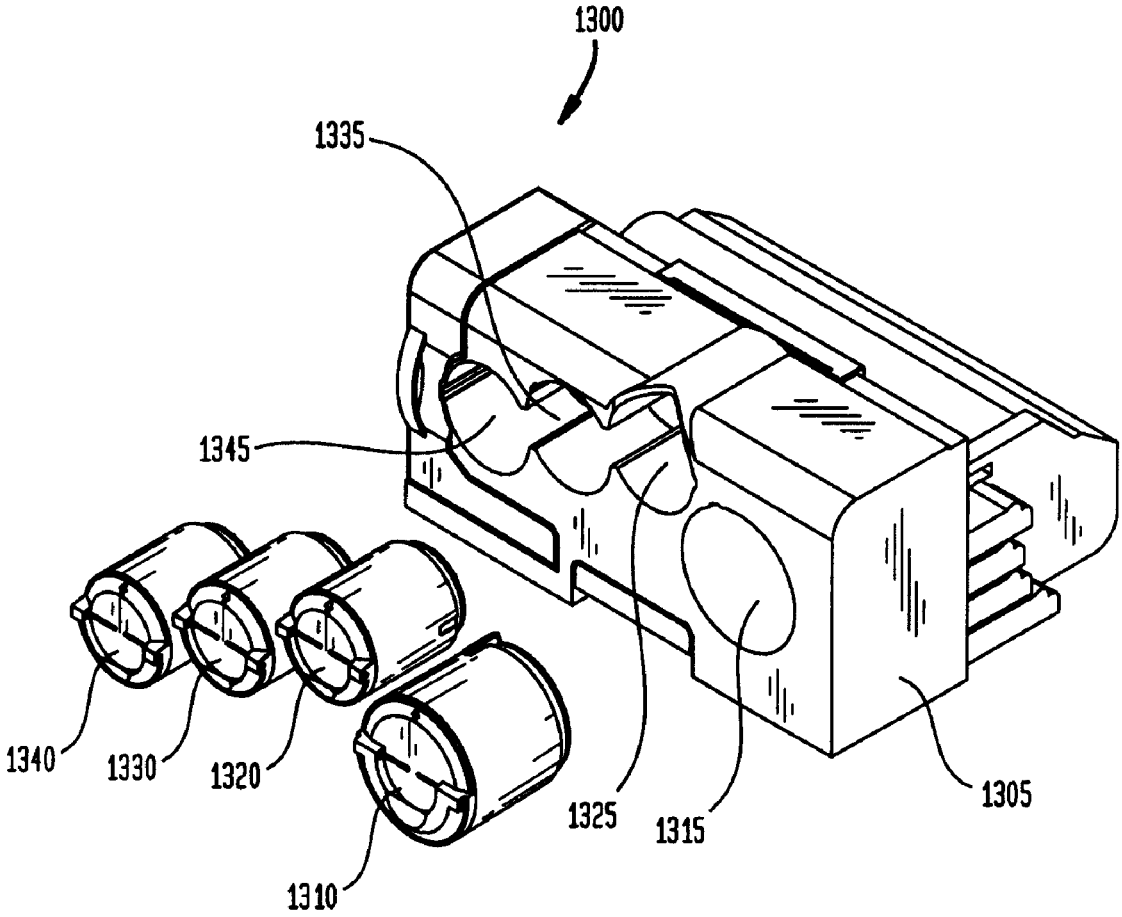
FIG. 9 (PRIOR ART)
FIG. 9 shows an exploded perspective view of a prior art Samsung CLP-300 toner cartridge.

Printer manufacturers have also developed smaller toner cartridges which may use shared components. By using shared components, the printer manufacturer may eliminate several components, thus creating a smaller, less expensive toner cartridge. FIG. 9 displays a prior art toner cartridge 1300 which utilizes a shared component system. The toner cartridge 1300 has a main housing 1305 which houses the various rollers, OPC drum, and other mechanical parts. The toner cartridge 1300 has four replaceable toner hopper assemblies which are substantially cylindrically shaped, a black toner hopper assembly 1310, a yellow toner hopper assembly 1320, a magenta toner hopper assembly 1330 and a cyan toner hopper assembly 1340. The black toner hopper assembly 1310 may be removed from and reinserted into a black toner hopper assembly recess 1315. Similarly, the other toner hopper assemblies may be removed and inserted into their respective recesses, a yellow toner hopper assembly recess 1325, a magenta toner hopper assembly recess 1335, and a cyan toner hopper assembly recess 1345. As is shown in FIG. 9, the yellow toner hopper assembly 1320, the magenta toner hopper assembly 1330 and the cyan toner hopper assembly 1340 may be of similar size and slightly smaller than the black toner hopper assembly 1310.

Figure 10:
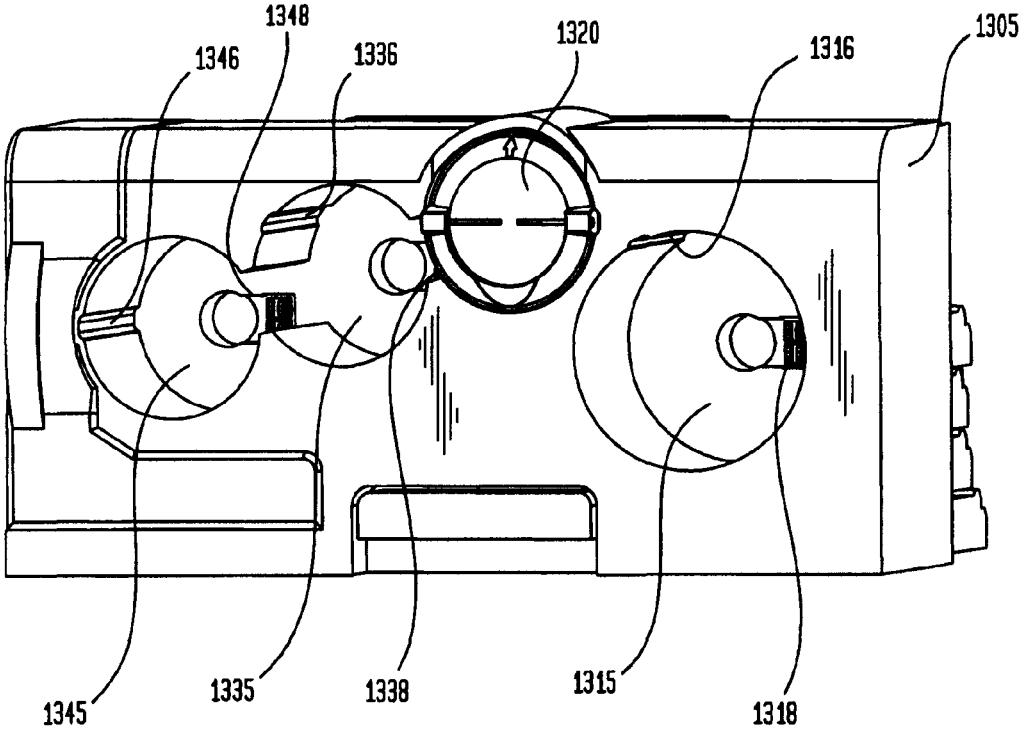
FIG. 10 (PRIOR ART)
FIG. 10 shows a front view of the toner cartridge of FIG. 9.

FIG. 10 displays a front perspective view of the main housing 1305 with the yellow toner hopper assembly 1320 installed. The printer manufacturer may implement a key slot within each toner hopper assembly recess (1315, 1325, 1335, and 1345) to restrict the insertion of an incorrect toner hopper assembly. For example, the black toner hopper assembly 1310 has a key which matches up to a black key slot 1316 located within the black toner hopper assembly recess 1315. The key slot locations may be unique for each toner hopper assembly. The magenta toner hopper assembly 1330 and the cyan toner hopper assembly 1340 have keys that match up to the magenta key slot 1336 in the magenta toner hopper assembly recess 1335 and the cyan key slot 1346 within the cyan toner hopper assembly recess 1345 respectively. Although it is unlikely that the black toner hopper assembly 1310 may be inserted into any of the other color toner recesses due to the size differential, the key slot may keep the black toner hopper assembly 1310 from being installed in a similar imaging process cartridge.

Within the toner hopper assembly recesses (1315, 1325, 1335, and 1345) are electrical contacts for each toner hopper assembly (1310, 1320, 1330 and 1340). Within the black toner hopper recess 1315 are black toner hopper contacts 1318. Correspondingly, within the other toner hopper recesses are yellow toner hopper contacts (not shown), magenta toner hopper contacts 1338, and cyan toner hopper contacts 1348. As is explained further in the discussions of FIG. 11, the different toner hopper contacts within the associated recesses mate up to electrical contacts of an electronic chip that is installed on the different toner hopper assemblies. When the toner hopper assemblies are completely inserted into the appropriate toner hopper assembly recesses, the contacts of the electronic chip make electrical contact with the toner hopper contacts within the toner hopper assembly recesses.

Figure 11:
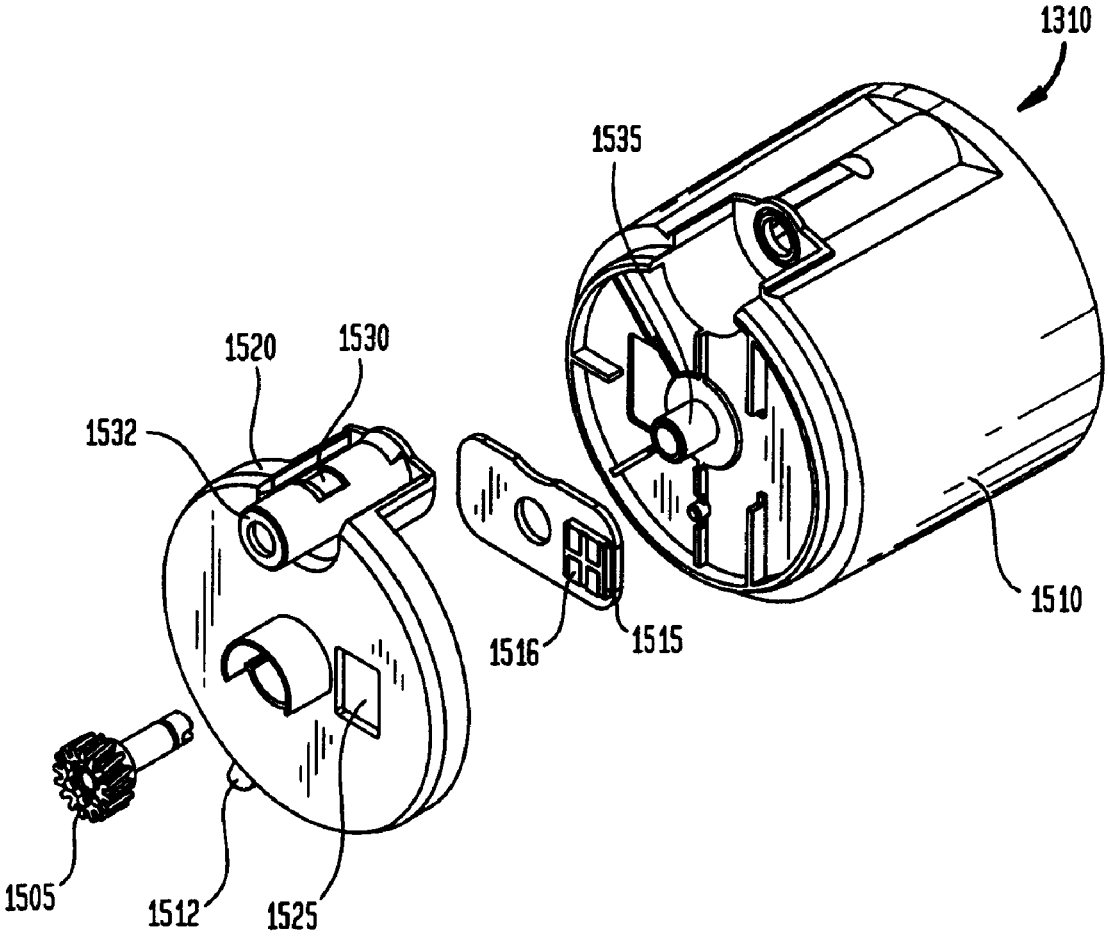
FIG. 11 (PRIOR ART)
FIG. 11 shows an exploded view of a prior art CLP-300 black toner hopper assembly.

FIG. 11 displays an exploded view of the prior art black toner hopper assembly 1310. The black toner hopper assembly 1310 has two sections, a main body 1510 and an end plate 1520. The end plate 1520 is attached on to the main body and may be secured into place with glue, an ultrasonic weld or other fastening means. The main body 1510 may be used to store black toner which is released during the printing process.

Before the end plate 1520 is affixed to the main body 1510, an electronic chip 1515 may be installed on the main body 1510. The electronic chip 1515 may be placed over a gear shaft housing 1535 and the end plate 1520 be secured into place. As can be seen in FIG. 11, the electronic chip 1515 has a set of electrical contacts 1516. The electrical contacts 1516 extend above the main body 1510 and protrude through an electrical contact window 1525 of the end plate 1520. The electrical contacts 1516 mate up and electrically connect to the black toner contacts 1318 within the black toner hopper assembly recess 1315 when the black toner hopper assembly 1310 is installed in the toner cartridge 1300. After the end plate 1520 has been attached to the main body 1510, a drive gear 1505 is inserted into the black toner hopper assembly 1310. The drive gear 1505 operates an agitator (not shown) that agitates the black toner within the main body 1510 of the black toner hopper assembly 1310. Agitating the black toner causes the black toner to drop through a toner window 1530, which is located on a toner protrusion 1532. When the black toner hopper assembly 1310 is installed in the toner cartridge 1300, the black toner drops through the toner window 1530 and enters the main housing 1305.

Figure 12:
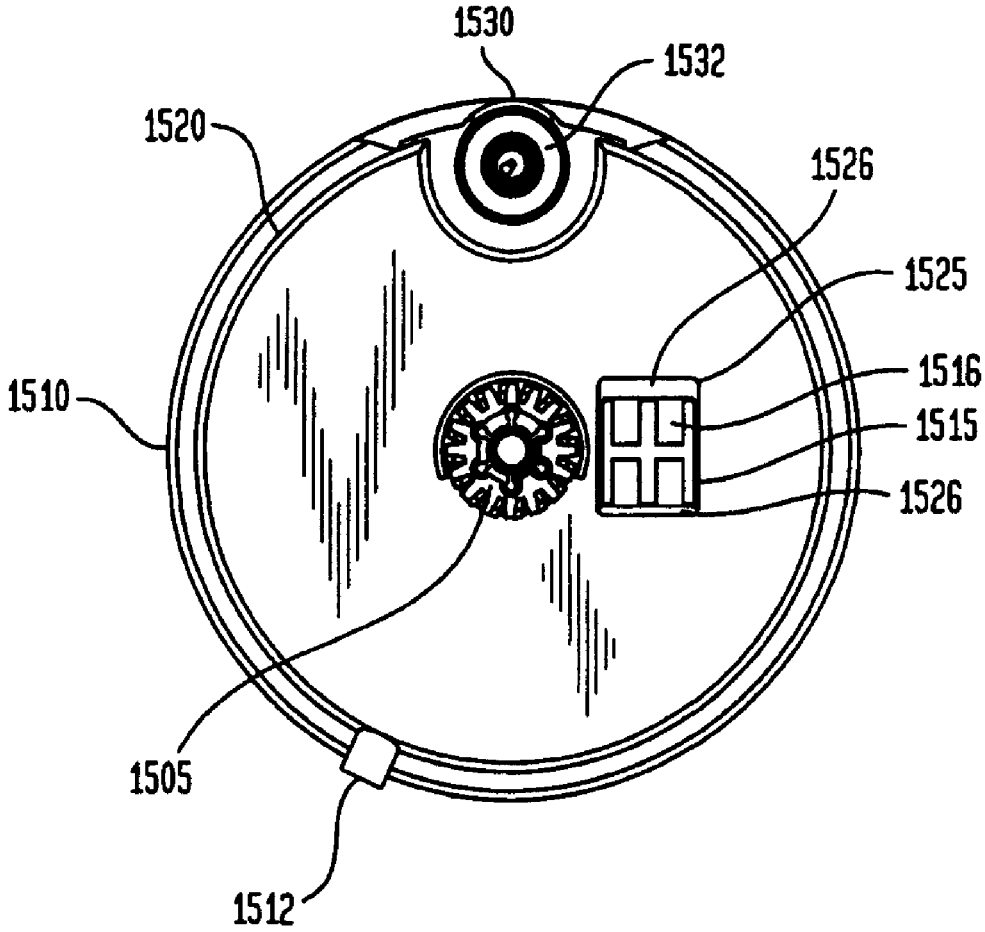
FIG. 12 (PRIOR ART)
FIG. 12 shows a top view of the assembled CLP-300 black toner hopper assembly of FIG. 11.

FIG. 12 displays a top view of the assembled black toner hopper assembly 1310. On the side of the end plate 1520 is a black key 1512 that aligns with the black key slot 1316 located within the black toner hopper assembly recess 1315 of the main housing 1305. As mentioned previously, the black keys 1512 may prevent the black toner hopper assemblies from being physically inserted into the incorrect toner hopper assembly recesses. Also shown in FIG. 12 are gaps 1526 located in the electrical contact window 1525. The gaps 1526 exist between the electrical contacts 1516 and the sides of the electrical contact window 1525.

The electronic chip 1515 may comprise a printed circuit board upon which electrical components and the electrical contacts 1516 may be mounted. When the black toner hopper assembly 1310 is installed in the toner cartridge 1300 and the toner cartridge 1300 is installed in the printer, the electronic chip 1515 may send and receive data sent to and from the printer. Some examples of data stored in the electronic chip 1515 may include printer type, imaging process cartridge serial number, the manufacturing date, the number of pages printed (page count), percentage of toner remaining, yield (expected number of pages), color indicator, toner-out indicator, toner low indicator, and the like.

After a predetermined number of prints, the printer may determine that all of the usable toner within the individual toner hopper assembly (1310, 1320, 1330 or 1340) may have been consumed. As a result, the printer may disable the individual toner hopper assembly (1310, 1320, 1330 or 1340) in order to make the consumer replace the disabled toner hopper assembly. The printer may disable the electronic chip 1515 by writing a specific value into a memory location within the electronic chip 1515. Once this value is written into the memory location, the value may not be overwritten by the printer. Hence, each time the printer communicates with the electronic chip 1515 and reads the value from that location, the printer may determine that the toner hopper assembly is spent and unusable. The printer may then disable the toner hopper assembly and display an appropriate message on the printer display panel. The disabled toner hopper assembly may be either discarded or recycled by a toner hopper assembly remanufacturer.

In order to recycle the disabled toner hopper assembly the imaging process cartridge remanufacturer may repair or replace the electronic chip 1515 as well as refill the toner, and repair or replace any other non-functioning components. A replacement chip may be designed to replace the non-functioning electronic chip. The replacement chip may be functionally equal (i.e. provide the same functionality as the electronic chip 1515). Thus, when a remanufactured toner hopper assembly with a replacement chip is installed in an imaging process cartridge, which is inserted back into the printer, the printer would allow the remanufactured imaging process cartridge to operate normally.

Figure 13:
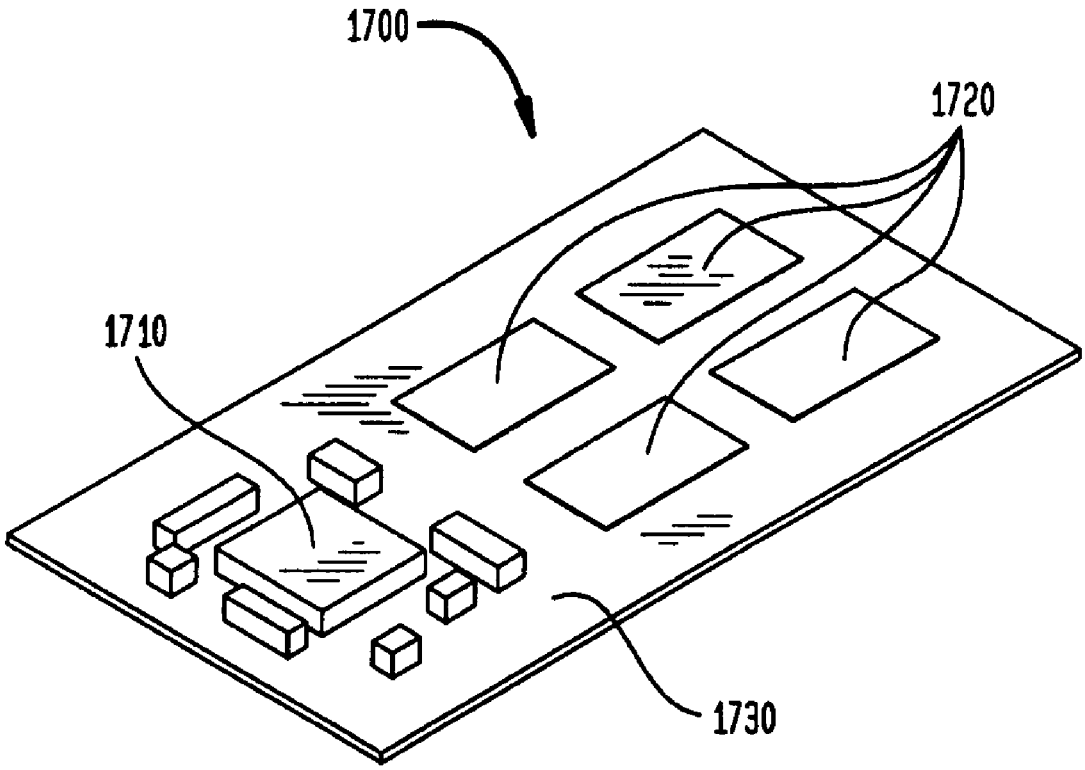
FIG. 13 shows a top perspective view of a replacement chip having electrical components and electrical contacts on the same side of a printed circuit board in accordance with one embodiment of the present invention.
Figure 14:
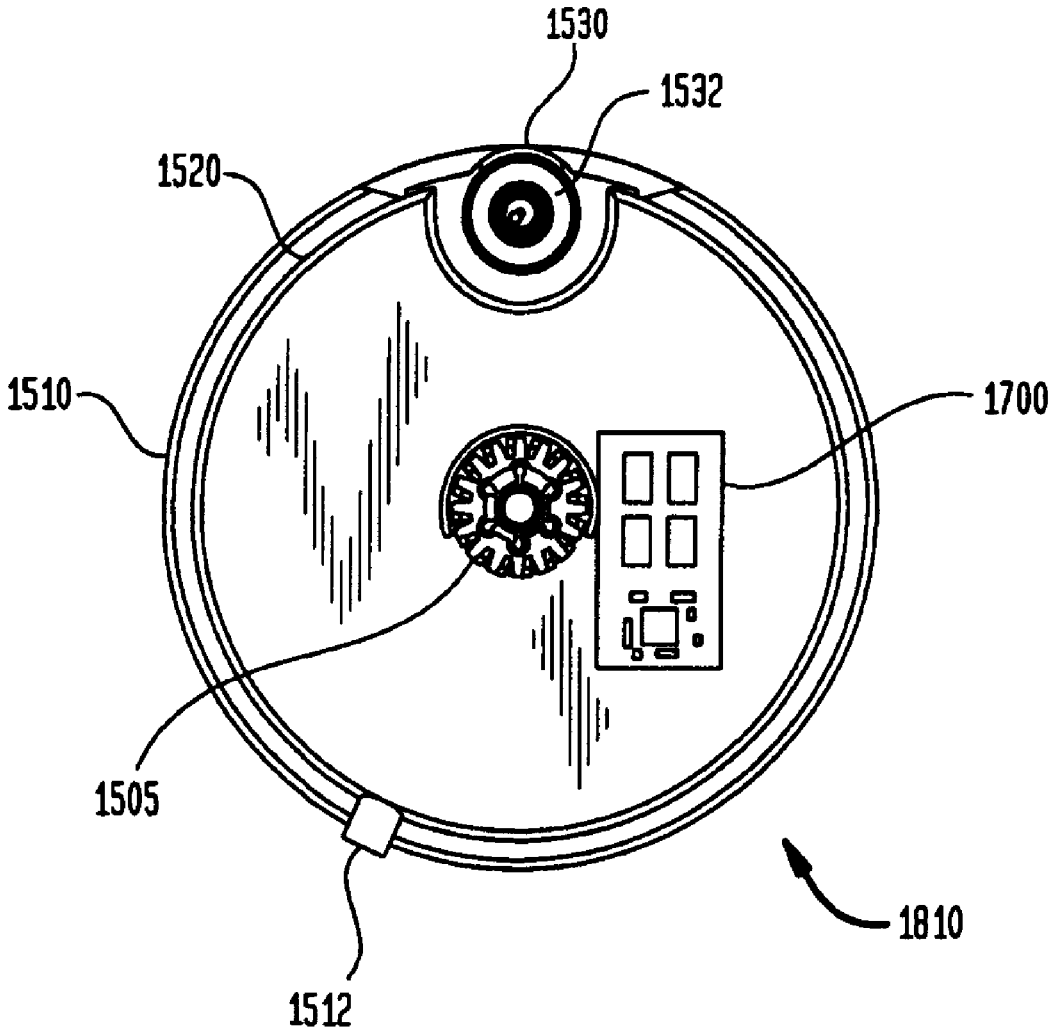
FIG. 14 shows a top view of the replacement chip of FIG. 13 attached to the black toner hopper assembly.

FIG. 13 shows a replacement chip 1700 in accordance with one embodiment of the present invention. The replacement chip 1700 has electronic components 1710 and electrical contacts 1720 positioned on a printed circuit board (PCB) 1730. The electrical contacts 1720 may mirror the configuration of the electrical contacts 1516 of the electronic chip 1515. By mirroring the electrical configuration of the electronic chip 1515, the electrical contacts 1720 of the replacement chip 1700 may be placed over the electrical contacts 1516 of the electronic chip 1515 as is displayed in a modified black toner hopper assembly 1810 as shown in FIG. 14. The replacement chip 1700 may offer the same functionality as the electronic chip 1515 when the replacement chip 1700 is installed on the black toner hopper assembly 1310. For example, the replacement chip 1700 programmed for use on a black toner hopper assembly 1310 for the Samsung CLP-300 printer may be used to repair a non-functioning black toner hopper assembly for the same printer having a non-functioning electronic chip 1515. When the modified black toner hopper assembly 1810 is inserted into the black toner hopper assembly recess 1315, the electrical contacts 1720 may make electrical contact with the black toner contacts 1318.

The thickness of the PCB 1730 of the replacement chip 1700 may need to be quite thin. In one exemplary embodiment, the thickness of the PCB 1730 may be less than about 0.012" (0.30 mm). The total height of the replacement chip 1700 may include the thickness of the PCB 1730 plus the thickness of the electrical contacts 1720 or well as the height of the electrical components 1710, whichever is greater. Because the electrical contacts 1516 are flush with the top of the end plate 1520, there may be little room to position the replacement chip 1700. If the height of the replacement chip 1700 was too tall, the resulting offset may cause a misalignment of the drive gear 1505 with the other gears within the toner cartridge 1300.

Figure 15A:
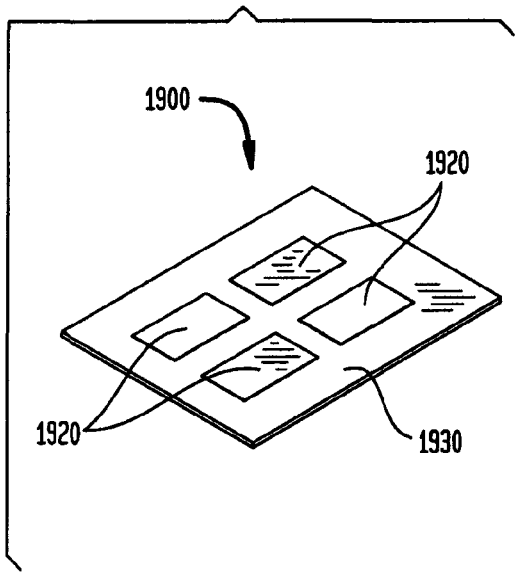
FIGS. 15A-15B show top and bottom perspective views of a replacement chip having electronic components on the edges of a printed circuit board in accordance with another embodiment of the present invention.
Figure 15B:
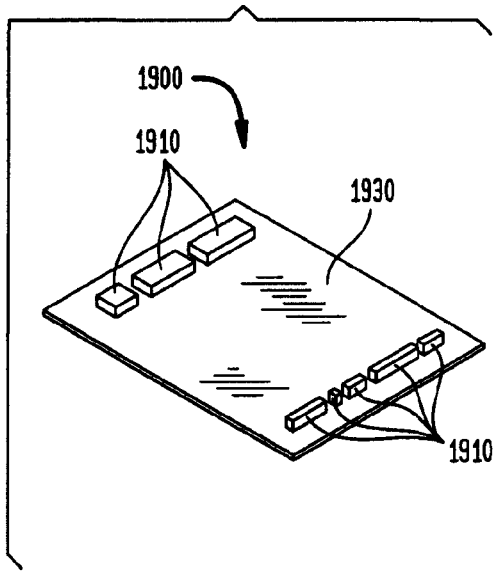

FIGS. 15A and 15B display a top view and a bottom view, respectively, of another replacement chip 1900 in accordance with another embodiment of the present invention. The replacement chip 1900 has electrical contacts 1920 located on the top of a PCB 1930. The electrical contacts 1920 mirror the electrical contacts 1516 of the electronic chip 1515. The replacement chip 1900 may offer the same functionality as the electronic chip 1515 when the replacement chip 1900 is installed on the black toner hopper assembly 1310. For example, the replacement chip 1900 programmed for use on a black toner hopper assembly 1310 for the Samsung CLP-300 printer may be used to repair a non-functioning black toner hopper assembly for the same printer having a non-functioning electronic chip 1515.

Figure 16:
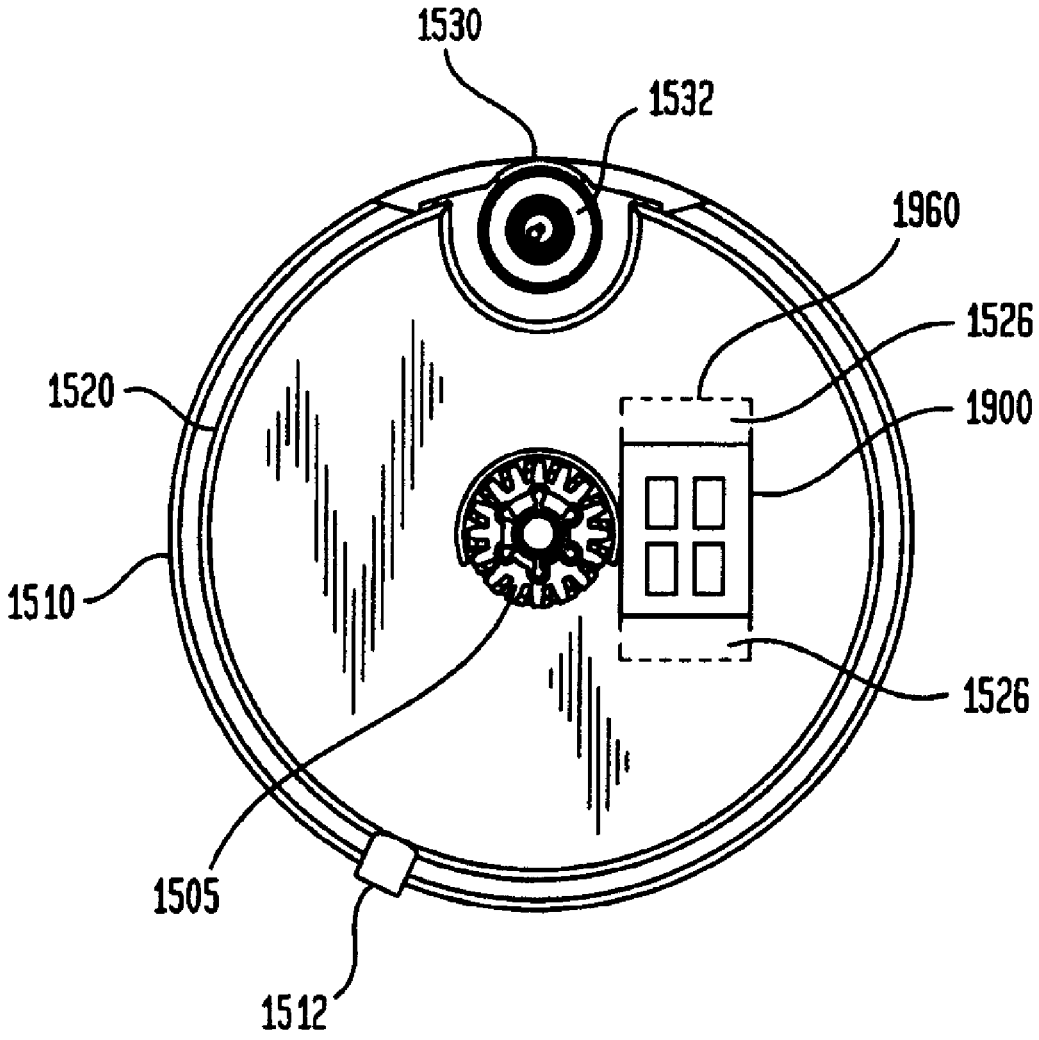
FIG. 16 shows a top view of the replacement chip of FIGS. 19A-19B attached to the black toner hopper assembly.

On the bottom of the replacement chip 1900 (FIG. 15B) electrical components 1910 may be arranged to the sides of the PCB 1930. By arranging the electronic components 1910 to the sides of the PCB 1930, the electrical components 1910 may protrude into the gaps 1526 that exist between the electrical contacts 1516 and the sides of the electrical contact window 1525 (FIG. 12) when the replacement chip 1900 is positioned over the electronic chip 1515. Alternatively, as is displayed in FIG. 16, the electrical contact window 1525 may also be enlarged as illustrated by dashed lines 1960. Enlarging the electrical contact window 1525 creates larger gaps 1526, allowing additional space for the electrical components 1910. FIG. 16 shows the replacement chip 1900 installed over the electronic chip 1515. The replacement chip 1900 may be secured into place using epoxy, glue or other appropriate securing means.

Figure 17:
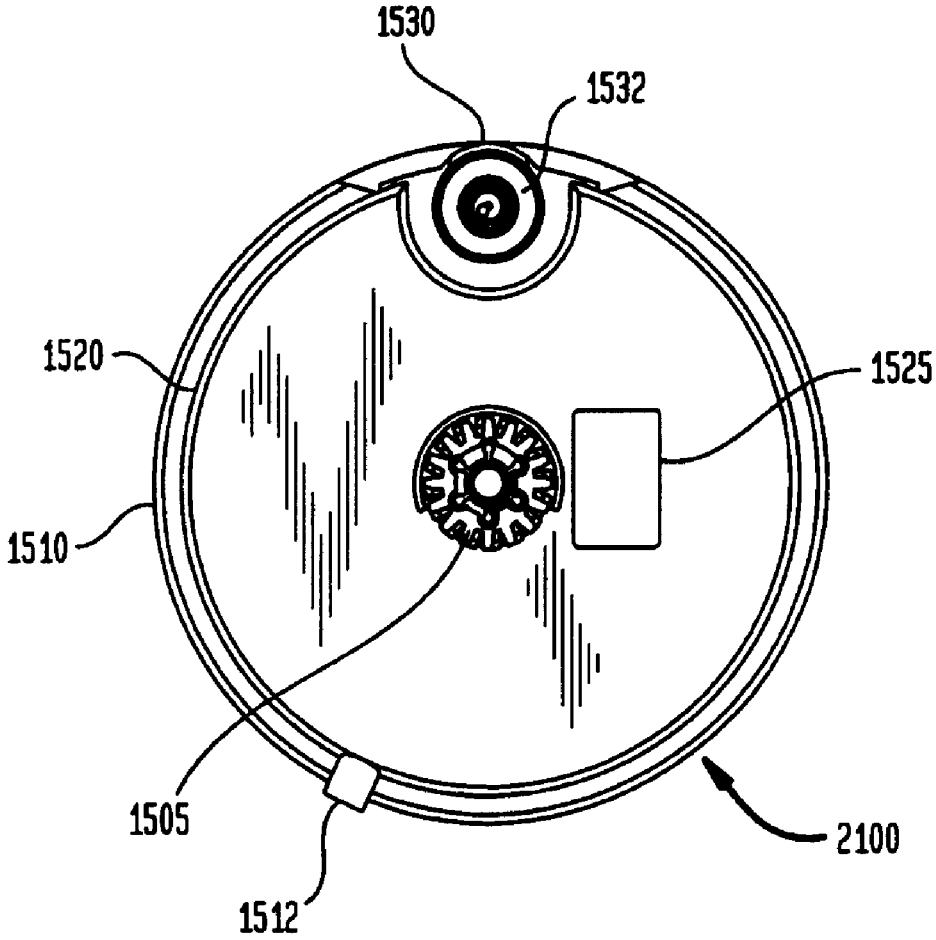
FIG. 17 shows a top view a modified black toner hopper assembly with a portion of the electronic chip removed.

In yet another embodiment, a portion of the electronic chip 1515 may be removed from the electrical contact window 1525. The portion may be removed using a power tool such as a drill, Dremmel® or the like. Alternatively, the portion may be removed using a sharp instrument such as an exacto knife, box cutter or the like. FIG. 17 shows a modified black toner hopper assembly 2100 having the portion of the electronic chip 1515 removed. With the removal of the portion, the electrical contact window 1525 no longer contains the contacts 1516 of the electronic chip 1515. As a result a replacement chip 2200 as displayed in FIGS. 18A and 18B may be installed over the electrical contact window 1525.

Figure 18A:
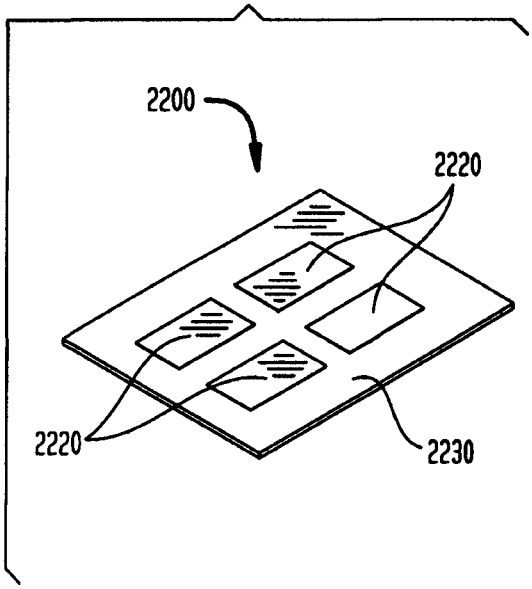
FIGS. 18A-18B show top and bottom perspective views of a replacement chip having electronic components in the center of a printed circuit board in accordance with another embodiment of the present invention.
Figure 18B:
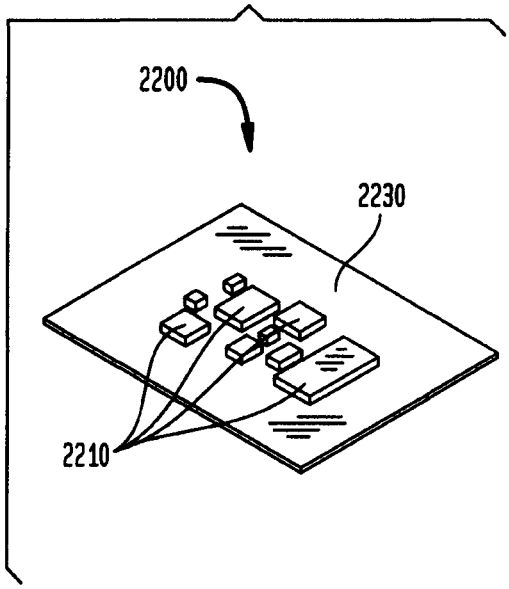
Figure 19:
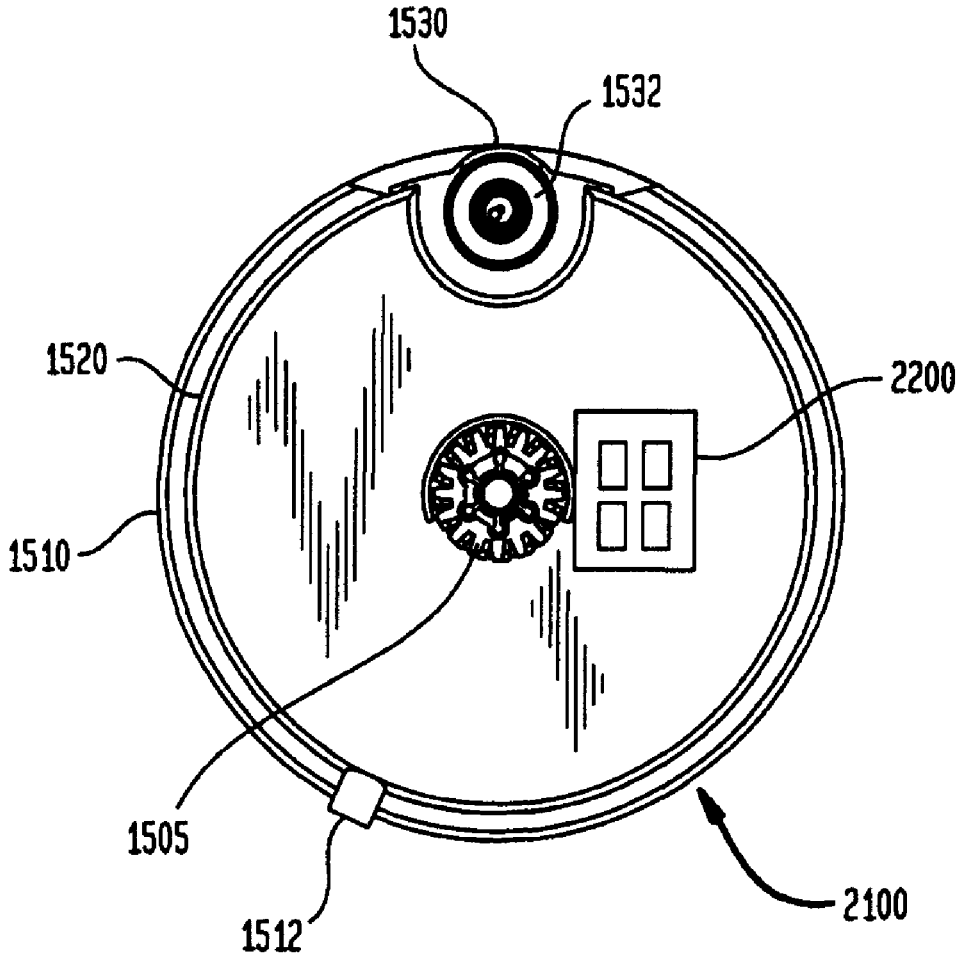
FIG. 19 shows a top view of the replacement chip of FIGS. 18A-18B attached to the black toner hopper assembly.

FIG. 18A displays a top perspective view of the replacement chip 2200. As shown in FIG. 18A, there are four electrical contacts 2220 positioned on the top of a PCB 2230. FIG. 18B shows a bottom perspective view of the replacement chip 2200. As can be seen in FIG. 18B, the electrical components 2210 may be positioned towards the center of the PCB 2230. With the portion of the electronic chip 1515 removed, the electrical components 2210 may protrude into the electrical contact window 1525 when the replacement chip 2200 is installed on the modified black toner hopper assembly 2100 as is shown in FIG. 19. The replacement chip 2200 may offer the same functionality as the electronic chip 1515 when the replacement chip 2200 is installed on the black toner hopper assembly 1310. For example, the replacement chip 2200 programmed for use on a black toner hopper assembly 1310 for the Samsung CLP-300 printer may be used to repair a non-functioning black toner hopper assembly for the same printer having a non-functioning electronic chip 1515.

Figure 20A:
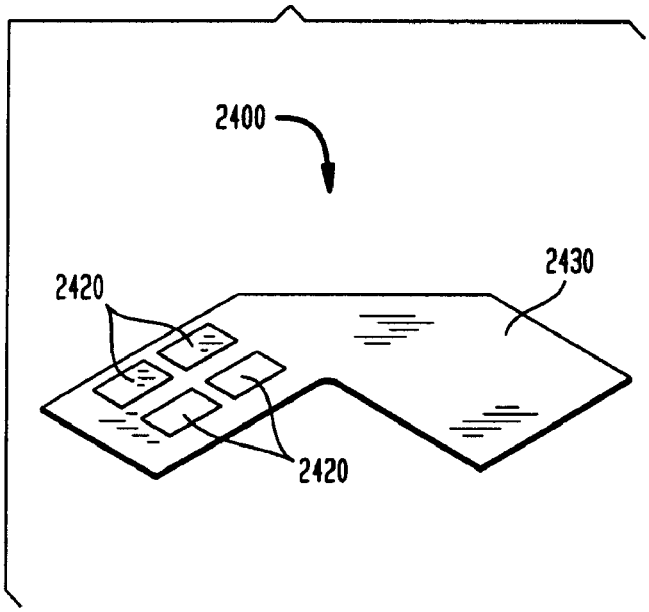
FIGS. 20A-20B show top and bottom perspective views of an irregularly shaped replacement chip in accordance with another embodiment of the present invention.
Figure 20B:
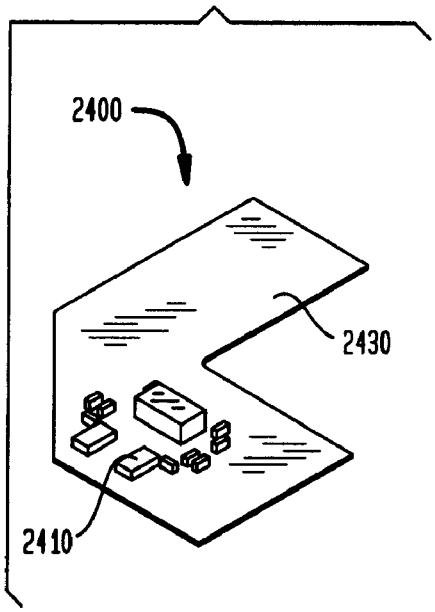

FIGS. 20A and 20B display yet another replacement chip 2400 in accordance with another embodiment of the present invention. The endplate 1520 may be modified to accept the replacement chip 2400. FIG. 20A shows a top perspective view of the replacement chip 2400. The replacement chip 2400 has a set of four electrical contacts 2420 positioned on a printed circuit board 2430 (PCB). The electrical contacts 2420 are in the same configuration as the electrical contacts 1516 of the electronic chip 1515. FIG. 20B shows a bottom perspective view of the replacement chip 2400 and the electrical components 2410 that extend out from the PCB 2430. The replacement chip 2400 may offer the same functionality as the electronic chip 1515 when the replacement chip 2400 is installed on the black toner hopper assembly 1310. For example, the replacement chip 2400 programmed for use on a black toner hopper assembly 1310 for the Samsung CLP-300 printer may be used to repair a non-functioning black toner hopper assembly for the same printer having a non-functioning electronic chip 1515.

Figure 21A:
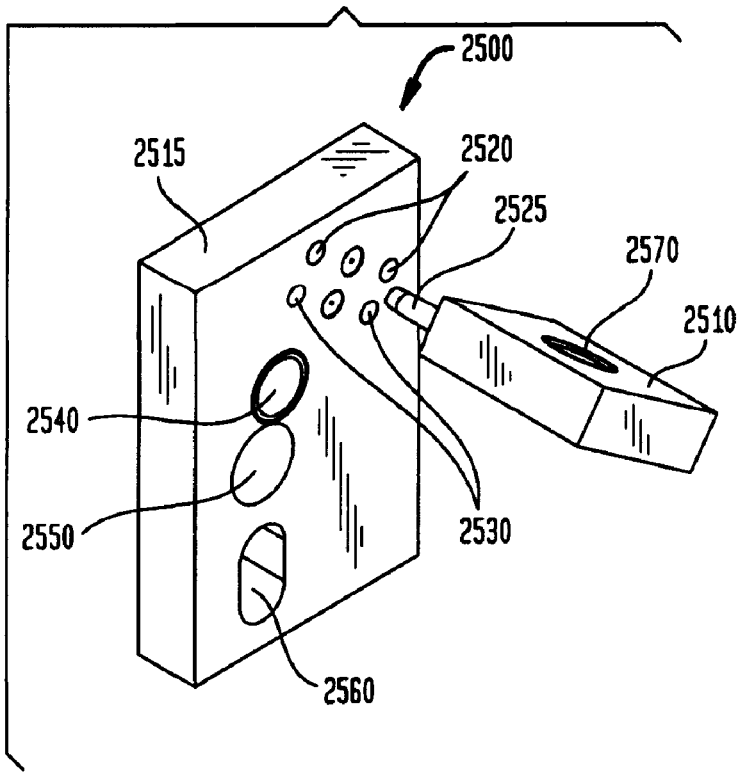
FIG. 21A shows an exploded view of a drilling template in accordance with an embodiment of the present invention.
Figure 21B:
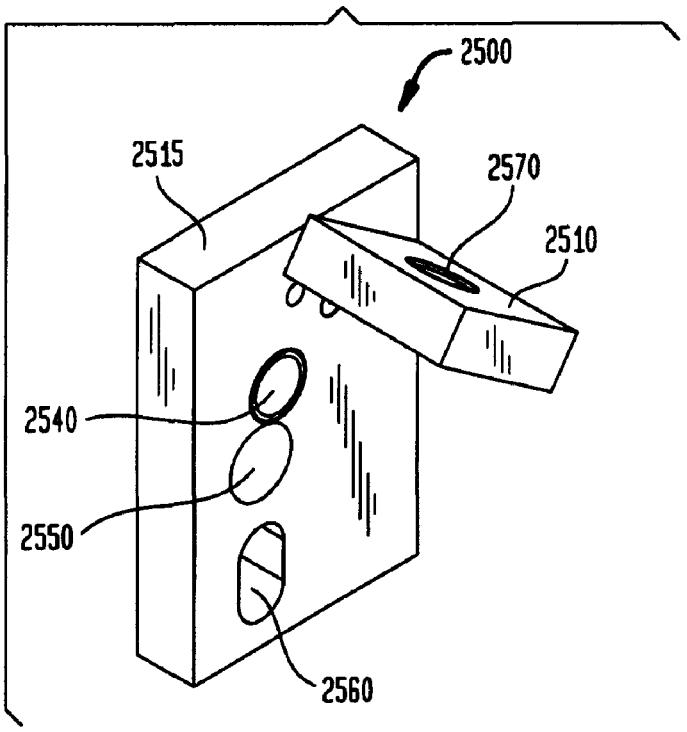
FIG. 21B shows an assembled view of a drilling template of FIG. 20A.

The endplate 1520 may be modified by utilizing a modification template 2500 as displayed in FIGS. 21A and 21B. The modification template 2500 has an adjustable portion 2510 and a template housing 2515. The adjustable portion 2510 has two legs 2525 which extend in an outward direction. The two legs 2525 insert into either an outer set 2520 or inner set 2530 of holes on the template housing 2515. The adjustable portion 2510 also has a toner extraction bore 2570 that may be used as a boring guide to remove a portion of the main body 1510 to facilitate the toner removal process. In addition to the outer set 2520 and the inner set 2530 of holes, the template housing 2515 also has a modification bore 2540, a gear opening 2550 and a toner protrusion guide 2560. The modification template 2500 may be constructed from aluminum, steel, hard plastic or other suitable materials.

The black toner hopper assembly 1310 is larger than the other color toner hopper assemblies (i.e. the yellow toner hopper assembly 1320, the magenta toner hopper assembly 1330 and the cyan toner hopper assembly 1340). The modification template 2500 may be used for modifying the endplate 1520 of the black toner hopper assembly 1310 by inserting the legs 2525 of the adjustable portion 2510 into the outer set of holes 2520 as is displayed in the embodiment of FIG. 21B.

The location of the modification bore 2540 on the modification template 2500 may be designed based on the underlying structure beneath the endplate 1520. As displayed in FIG. 11, the electronic chip 1515 extends across the top of the main body 1510, centered on the gear shaft housing 1535. Thus, it may be advantageous to have the location of the modification bore 2540 away from the electronic chip 1515 but still close enough to the electrical contact window 1525. Keeping the location of the modification bore 2540 away from any structures beneath the endplate 1520 reduces the risk of damaging the toner hopper assembly when boring out the portion of the endplate 1520.

Figure 22A:
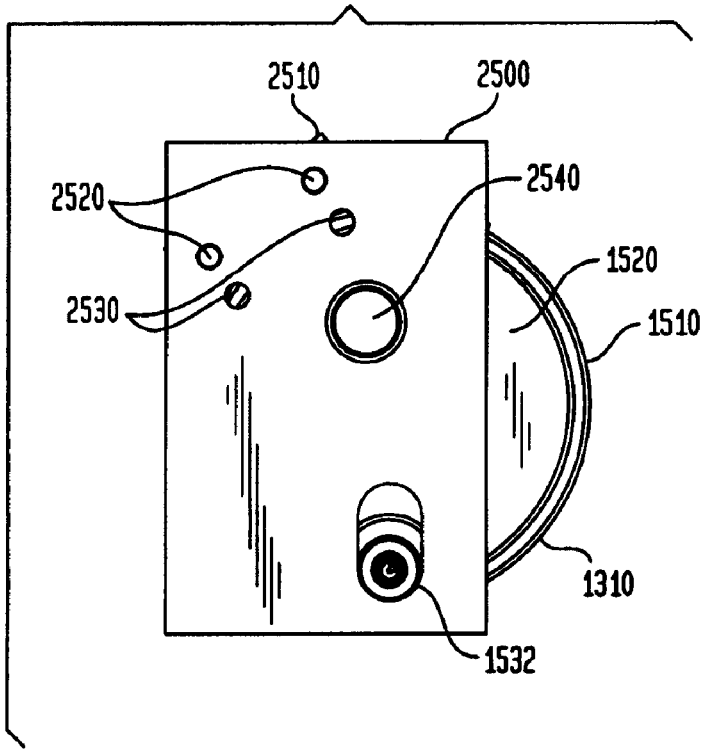
FIG. 22A shows a top view of the drilling template attached to the black toner hopper assembly.
Figure 22B:
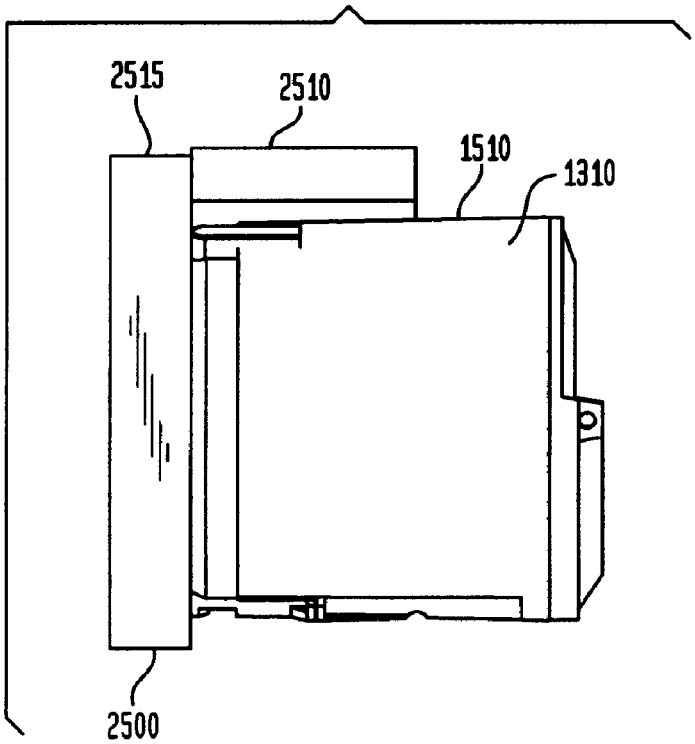
FIG. 22B displays a side view of the drilling template attached to the toner hopper assembly.

FIGS. 22A and 22B display the modification template 2500 placed over the endplate 1520 of the black toner hopper assembly 1310. As can be seen in FIG. 22A, the toner protrusion 1532 extends through the toner protrusion guide 2560. Although not shown in FIG. 22A, the gear shaft 1505 extends into the gear opening 2550. When the modification template 2500 is placed over the endplate 1520, the modification template 2500 is held in place by the combination of the adjustable portion 2510 being pressed against the main body 1510, the gear shaft 1505 pressing against the gear opening 2550 as well as the toner protrusion 1532 pressing against the toner protrusion guide 2560.

Figure 23:
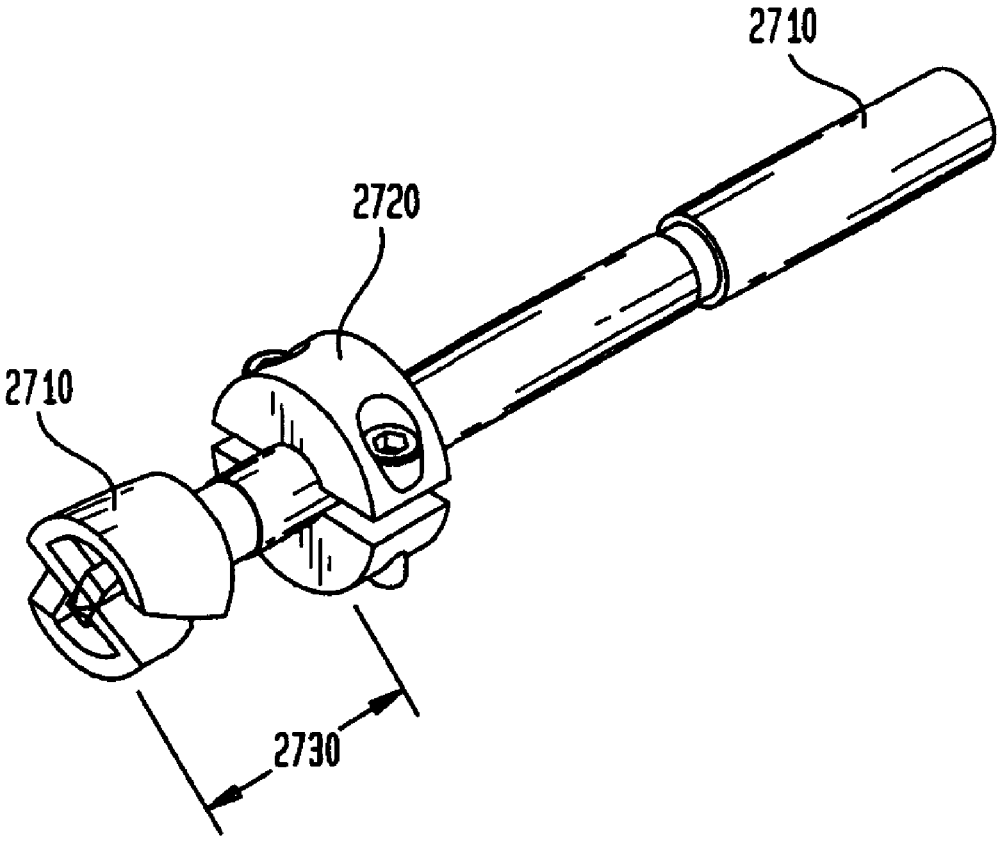
FIG. 23 displays an exemplary drill bit used with one embodiment of the present invention.

After the modification template 2500 has been placed over the endplate 1520, a boring tool such as a drill, Dremmel®, drill press or the like may be used to bore out a hole in the endplate 1520. One exemplary drill bit 2700 that may be used with such boring tool is displayed in FIG. 23. The drill bit 2700 has a boring end 2710 and a depth gauge 2720 which extends a depth 2730 from the tip of the boring end 2710. After the drill bit 2700 is attached to a suitable boring tool, the drill bit 2700 is inserted into the modification bore 2540 and a portion of the endplate 1520 is removed. The depth 2730 should be sufficient to allow the drill bit 2700 to bore only through the endplate 1520 without penetrating the main body 1510 of the toner hopper assembly. When assembled, there is a clearance between the endplate 1520 and the main body 1510 of less than about 0.1" (2.54 mm). The depth 2730 of the drill bit 2700 may be adjusted for different toner hopper assemblies.

After the portion of the endplate 1520 is removed using the modification template 2500 with the boring tool, a portion of the main body 1510 may also be removed to facilitate the emptying of the toner hopper assembly. With the modification template 2500 still attached, the boring end 2710 of the drill bit 2700 may be inserted into the toner extraction bore 2570 and a hole may be bored into the main body 1510. Once the hole has been created, the shavings from boring the hole as well as any remaining toner may be removed. As a final step in the remanufacturing process, new toner may be added to the toner hopper assembly and a plug (not shown) may be used to seal the hole in the main body 1510.

Figure 24:
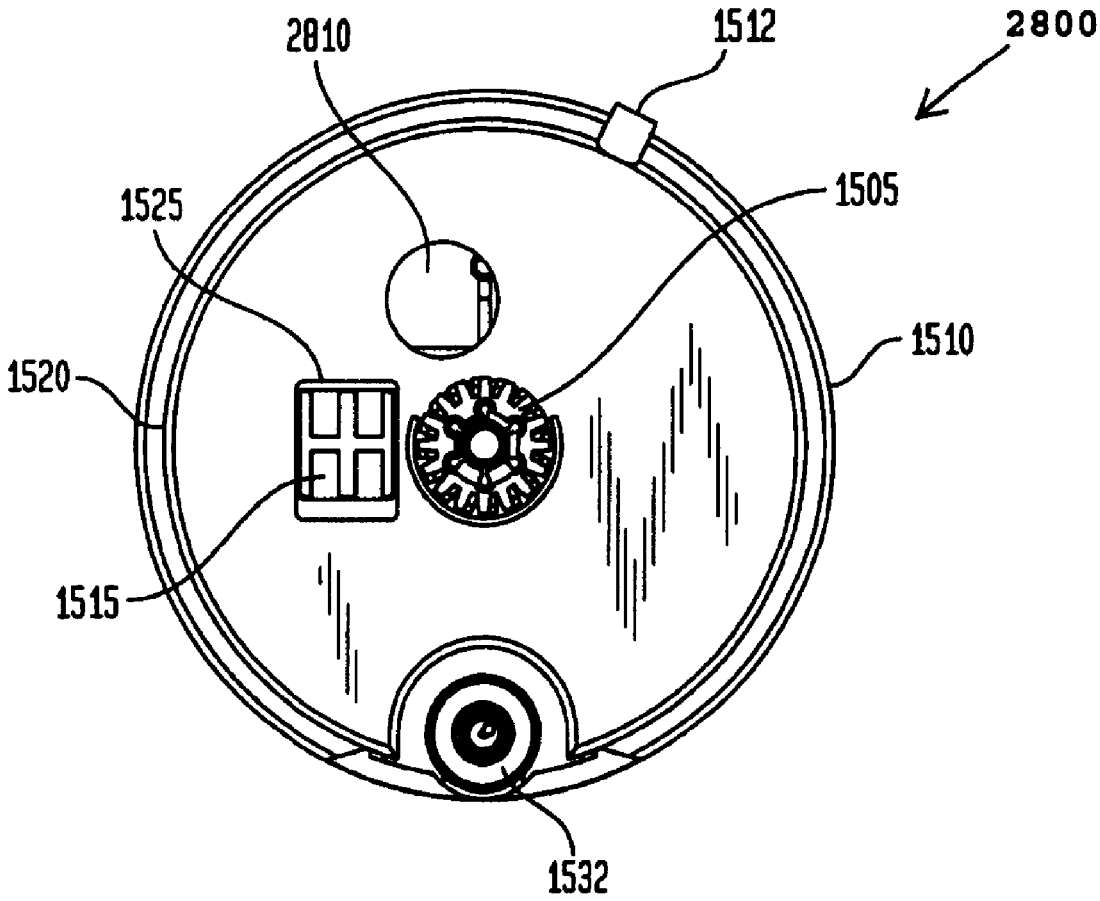
FIG. 24 displays a top view of a modified black toner hopper assembly with a hole bored into an endplate in accordance with another embodiment of the present invention.
Figure 25:
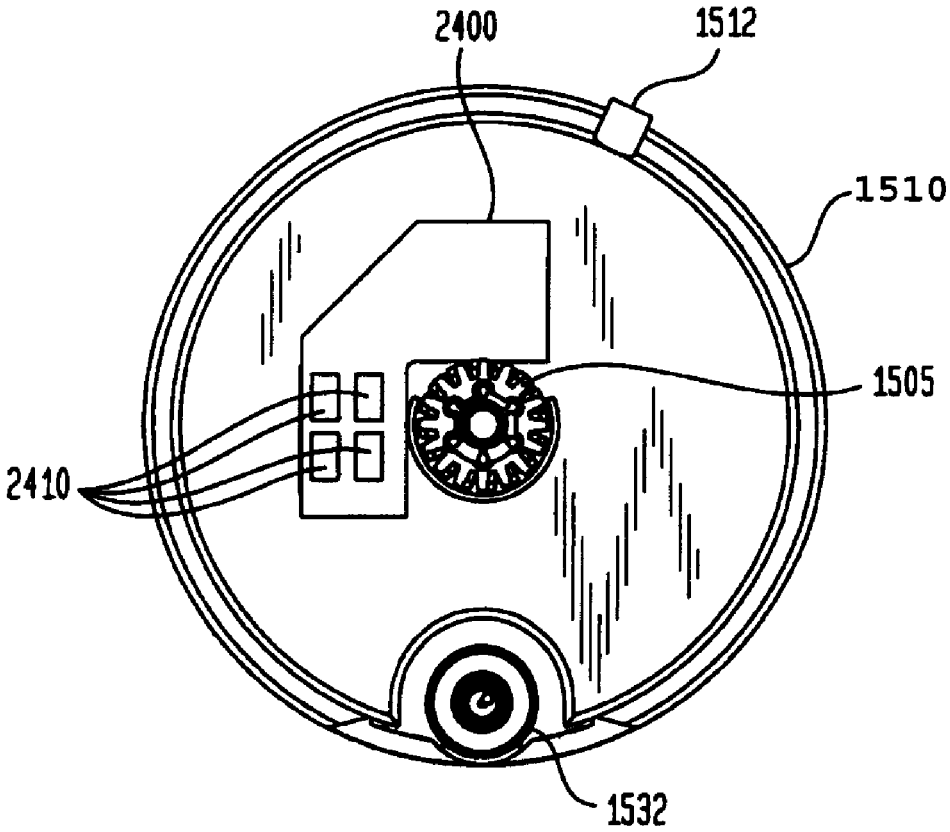
FIG. 25 displays a modified black toner hopper assembly with the replacement chip of FIGS. 20A-20B installed in accordance with one embodiment of the present invention.

FIG. 24 displays a top view of a modified toner hopper assembly 2800 in accordance with another embodiment of the present invention. The modified toner hopper assembly 2800 has a bore hole 2810 in the endplate 1520. Through the bore hole 2810, the main body 1510 of the toner hopper assembly can be seen. The replacement chip 2400 may then be attached onto the endplate 1520 of the modified toner hopper assembly 2800 as is shown in FIG. 25. The electronic components 2410 of the replacement chip 2400 extend into the bore hole 2810 when the replacement chip 2400 is affixed. The replacement chip 2400 is designed to provide enough clearance around the drive shaft 1505 when attached. In addition, the electrical contacts 2420 are positioned over the contacts 1525 of the electronic chip 1515.

Figure 26:
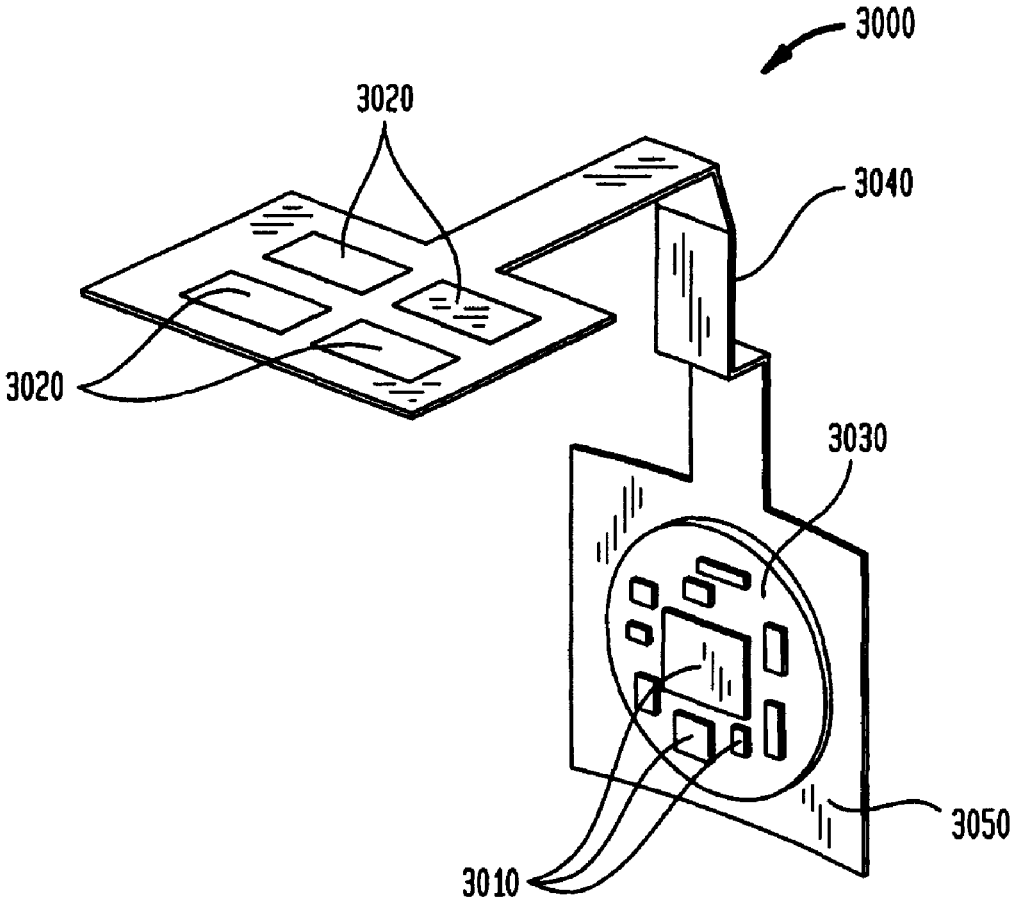
FIG. 26 shows a side perspective view of a replacement chip having the electronic components and electrical contacts connected by electrical wiring.

FIG. 26 displays a replacement chip 3000 in accordance with another embodiment of the present invention. The replacement chip 3000 has electrical components 3010 mounted on a PCB 3030. The PCB 3030 in turn may be attached to a curved flange 3050. The curved flange 3050 may be designed to follow the contours of the side of the main body 1510 of the black toner hopper assembly 1310. The position of the curved flange 3050 may correspond to the toner extraction bore 2570 of the modification template 2500. When a hole is bored into the side of the main body 1510, the curved flange 3050 of the replacement chip 3000 may be placed over the hole, with the electrical components 3010 extending into the hole. The curved flange may be secured into place using glue, epoxy or other adhesive means. Alternatively, a plug (not shown) may be inserted into the hole and the curved flange 3050 may be affixed to the plug.

The electrical components are electrically coupled via a conductive connector 3040 to electrical contacts 3020 which are positioned away from the PCB 3030. The conductive connector 3040 may be formed from thin strands of wire insulated in a non conductive sleeve. The replacement chip 3000 is designed so the electrical contacts 3020 may be positioned over the electrical contacts 1516 when the replacement chip 300 is installed over the electronic chip 1515 as shown in the modified toner hopper assembly 3100 displayed in FIG. 27.

Figure 27:
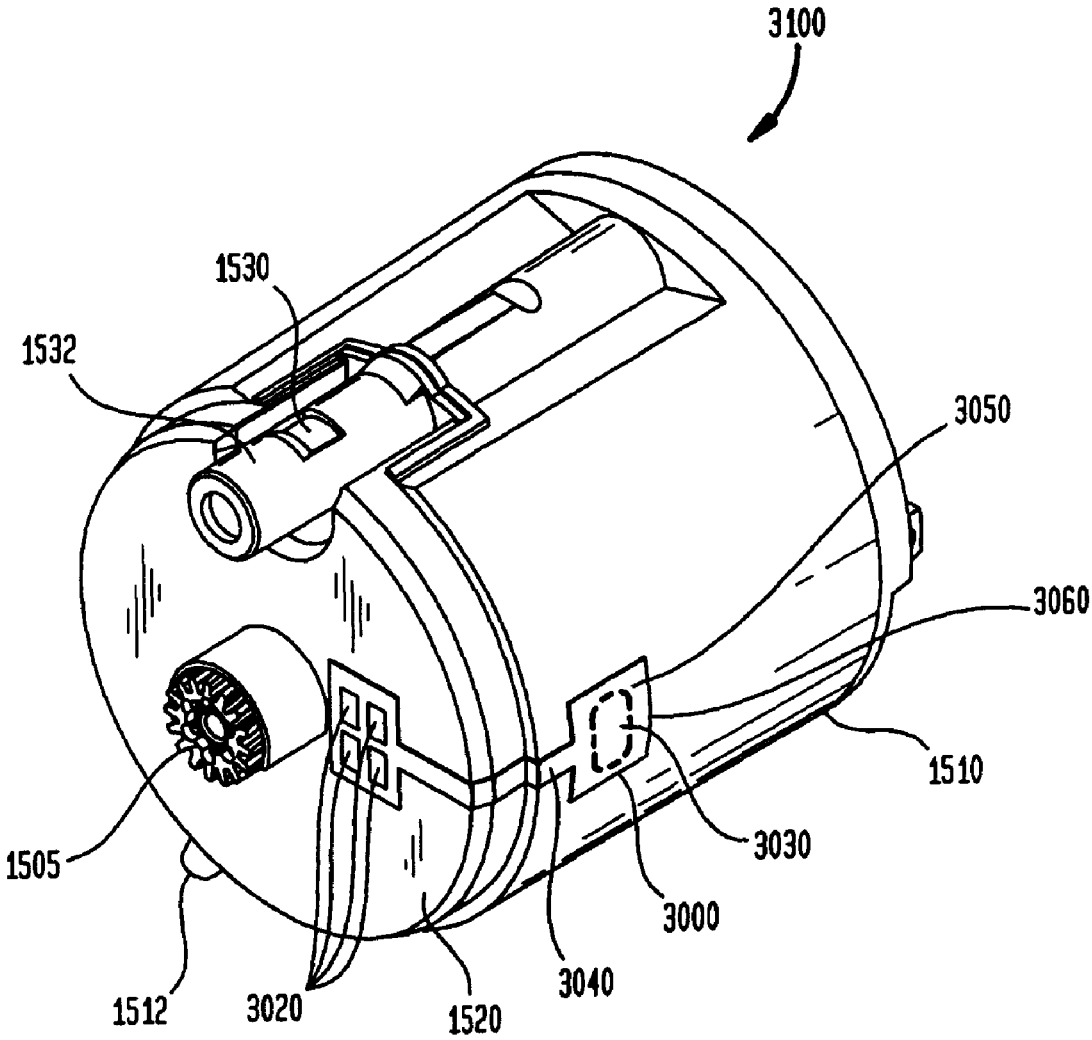
FIG. 27 shows a side perspective view of a modified black toner hopper assembly having the replacement chip of FIG. 26 attached in accordance with one embodiment of the present invention.

As is shown in modified black toner hopper assembly 3100 of FIG. 27, the conductive connector 3040 is formed around the contours of the faceplate 1520 as well as the side of the main body 1510. When installed, the electrical components 3010 are positioned against the side of the main body 1510. The height of the electrical components 3010 combined with the thickness of the PCB 3030 may be of sufficient height as to provide enough clearance so the modified black toner hopper assembly 3100 may be installed into the black toner hopper assembly recess 1315. If the combined height is too great, the modified black toner hopper assembly 3100 may become wedged prior to being completely inserted into the black toner hopper assembly recess 1315. A hole 3060 is displayed by the dashed line and the curved flange 3050 may be placed over the hole 3060.

Figure 28:
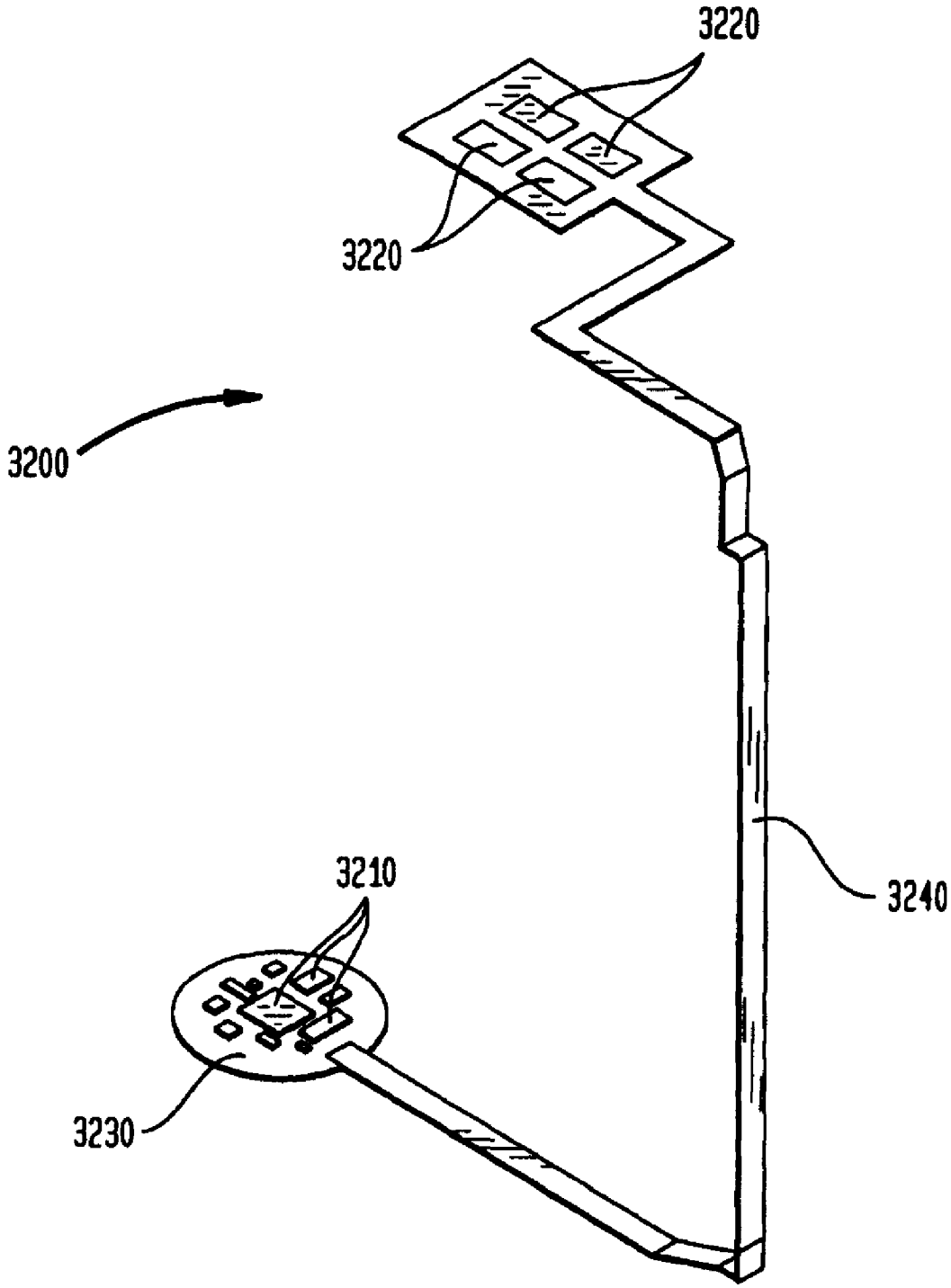
FIG. 28 shows a side perspective view of a replacement chip having the electronic components and electrical contacts connected by electrical wiring in accordance with another embodiment of the present invention.

FIG. 28 displays a replacement chip 3200 in accordance with another embodiment of the present invention. The replacement chip 3200 has electrical components 3210 mounted on a PCB 3230. The electrical components are electrically coupled via a conductive connector 3240 to electrical contacts 3220 which are positioned away from the PCB 3030. The conductive connector 3040 may be formed from thin strands of wire insulated in a non conductive sleeve. The replacement chip 3200 is designed so the electrical contacts 3220 may be positioned over the electrical contacts 1516 when the replacement chip 300 is installed over the electronic chip 1515 as shown in the modified toner hopper assembly 3300 displayed in FIGS. 29A and 29B.

Figure 29A:
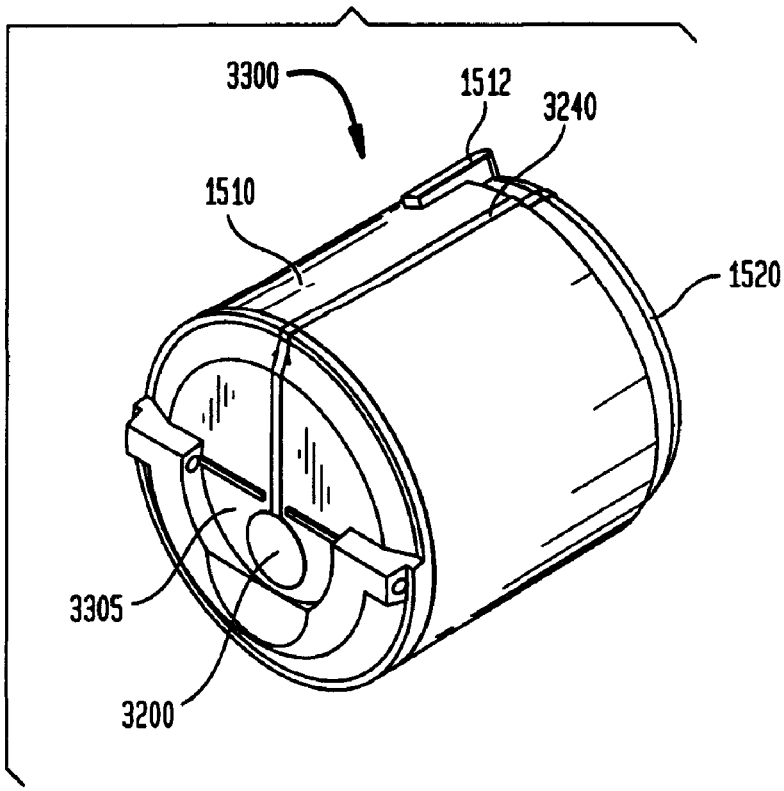
FIG. 29A-29B show side perspective views of a modified black toner hopper assembly having the replacement chip of FIG. 28 attached in accordance with one embodiment of the present invention.
Figure 29B:
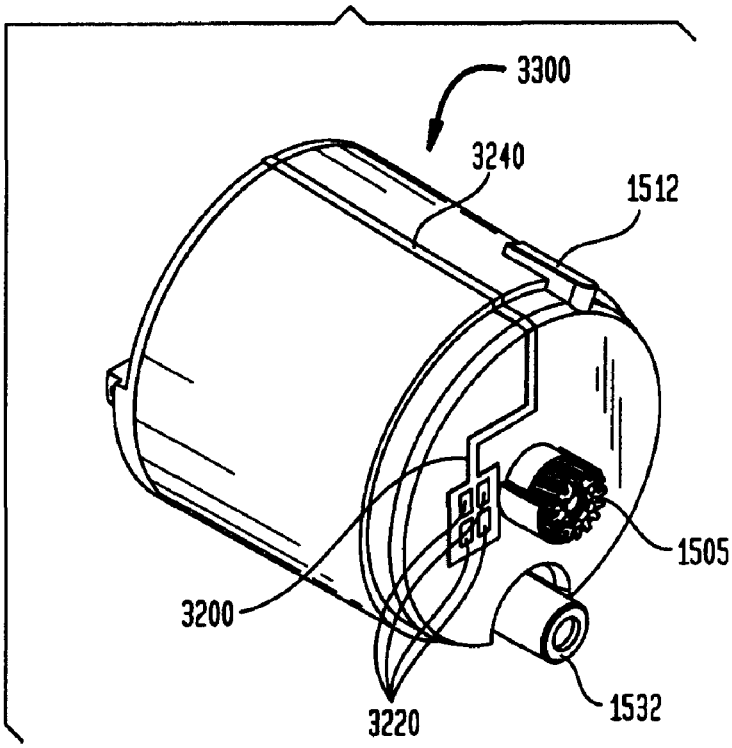

As is shown in modified black toner hopper assembly 3300 of FIGS. 29*a* and 29B, the conductive connector 3240 is formed around the contours of the endplate 1520 and extends down the entire side of the main body 1510. When installed, the electrical components 3210 are positioned against the bottom 3305 of the main body 1510. Similar to the modified black toner hopper assembly 3100 of FIG. 27, the PCB 3230 may be positioned over a hole that may be bored into the bottom 3305.

Figure 30:
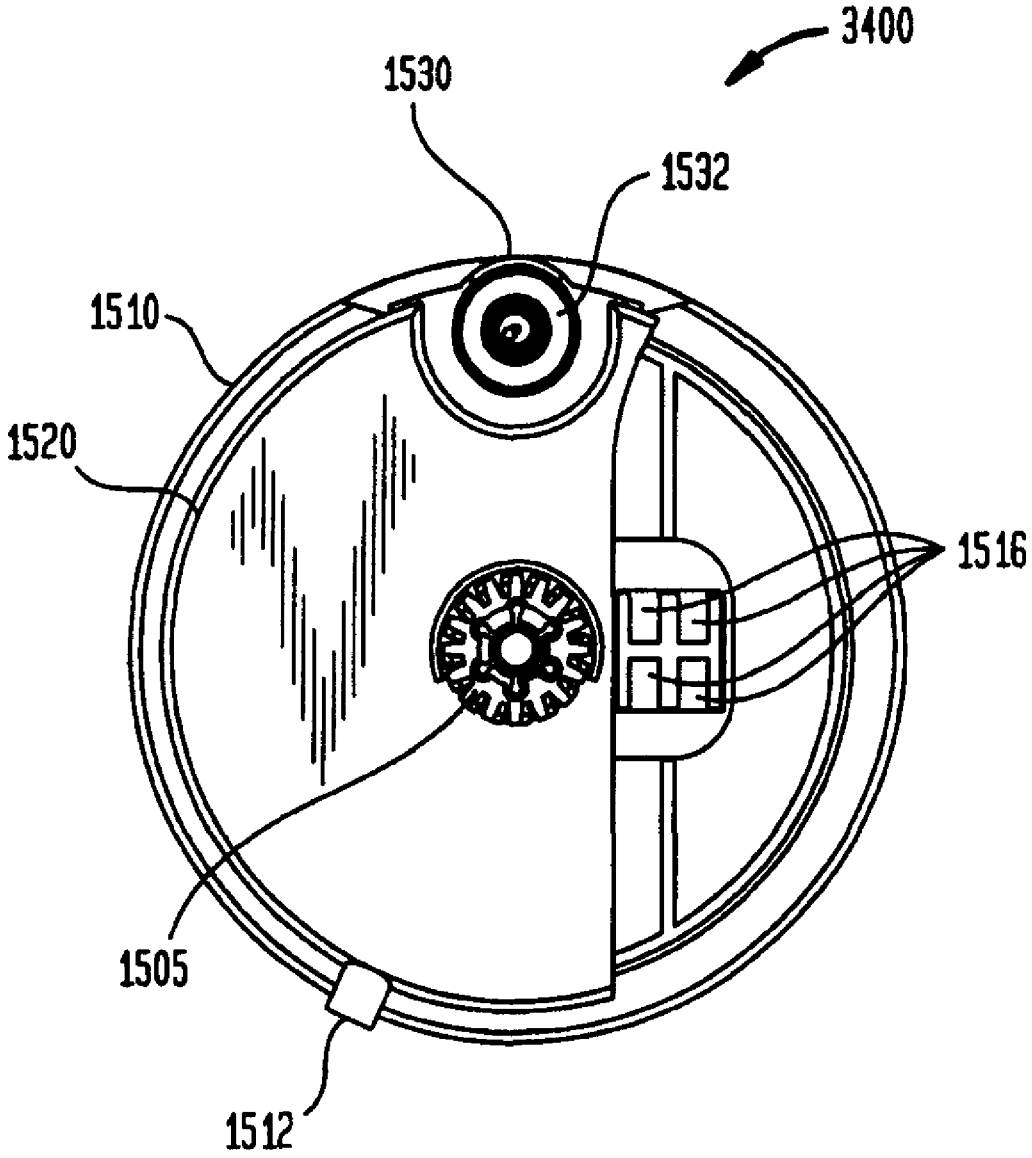
FIG. 30 displays a top view of a modified black toner hopper assembly having a section of the endplate removed in accordance with another embodiment of the present invention.

FIG. 30 displays a top view of another modified black toner hopper assembly 3400 in accordance with another embodiment of the present invention. The modified black toner hopper assembly 3400 has a section of the endplate 1520 removed. The section may be removed using a hacksaw, Dremmel, or other cutting instrument. With the section removed, the end of the electronic chip 1515 having the electrical contacts 1516 may be exposed. The end of the electronic chip 1515 may then be cut off and removed.

Figure 31:
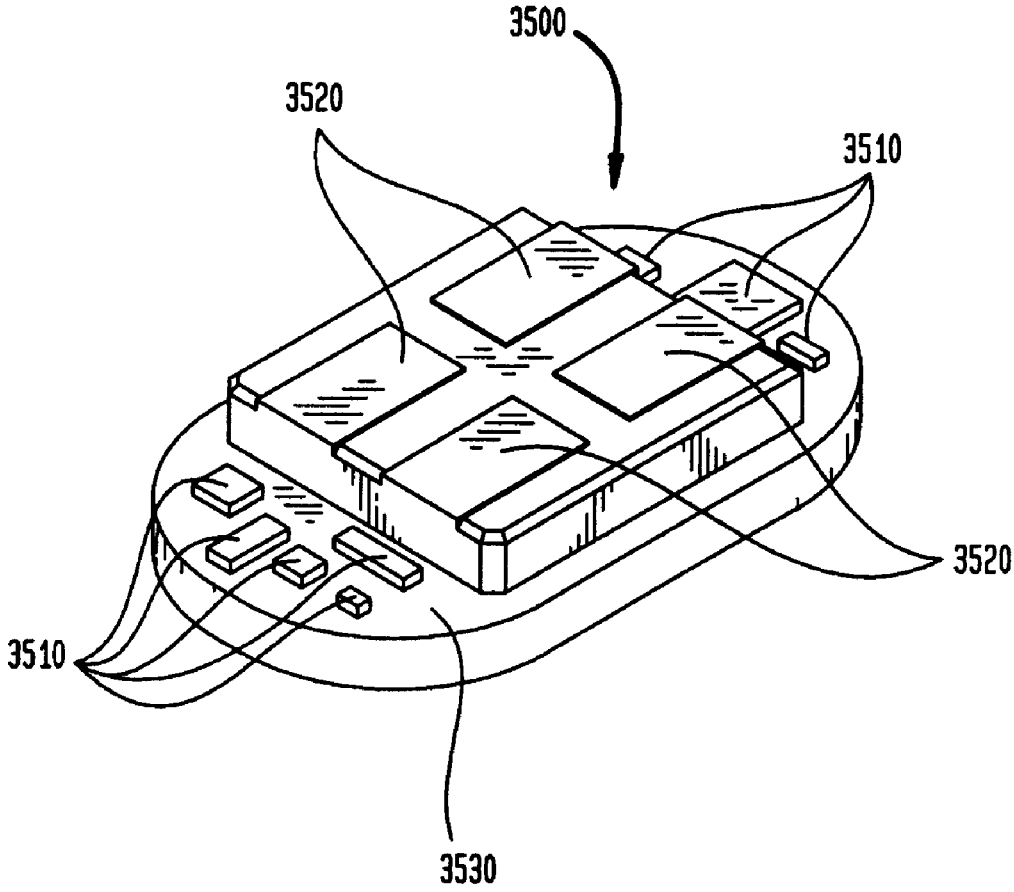
FIG. 31 shows a side perspective view of a replacement chip having the electrical contacts offset from the electronic components in accordance with another embodiment of the present invention; and, FIG. 32 displays a top view of a modified black toner hopper assembly having a section of the endplate removed and the replacement chip of FIG. 31 installed in accordance with another embodiment of the present invention.
Figure 32:
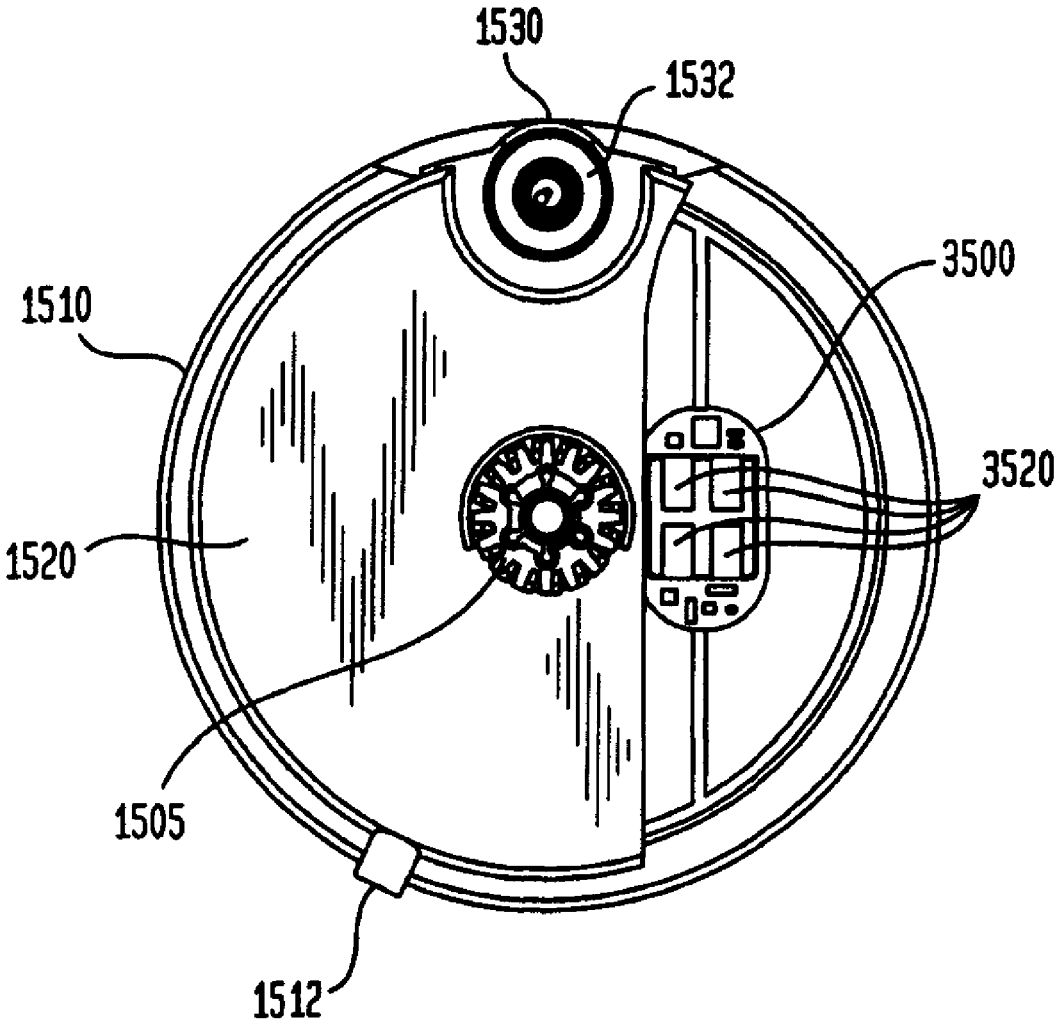

FIG. 31 shows a replacement chip 3500 in accordance with a further embodiment of the present invention. The replacement chip 3500 has electrical components 3510 and electrical contacts 3520 positioned on a PCB 3530. The replacement chip 3500 is designed so the electrical contacts 3520 may extend above the PCB 3530 so when the replacement chip 3500 is affixed to the modified black toner hopper assembly 3400 the contacts extend to about the same position the electrical contacts 1516 were before the section of the electronic chip 1525 was removed. FIG. 32 displays the replacement chip 3400 installed on a modified black toner hopper assembly 3400 in accordance with an embodiment of the present invention.

In addition to the aforementioned imaging process cartridge types (i.e. the black toner hopper assembly), the inventive concepts of the present invention may be applied to the other color toner hopper assemblies for the CLP-300 color laser printer as well as other toner hopper assemblies for other printer models including color and monochrome printers. Although specific embodiments have been illustrated and described herein, those of ordinary skill in the art appreciate that any arrangement, which is calculated to achieve the same purpose, may be substituted for the specific embodiments shown and that the invention has other applications in other environments. This application is intended to cover any adaptations or variations of the present invention. The following claims are in no way intended to limit the scope of the invention to the specific embodiments described herein.

Although specific embodiments have been illustrated and described herein, those of ordinary skill in the art appreciate that any arrangement that is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

What is claimed is:

1. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer.

wherein the electrical contacts of the replacement chin are placed over the electrical contacts of the at least partially non-functioning electronic chip, and wherein the replacement chip has electrical components and the electrical components are positioned in gaps which exist between the at least nonfunctioning electronic chip and the endplate when the replacement chip is placed over the at least partially non-functioning electronic chip.

2. The method of claim 1 wherein the gaps are widened by removing a part of the end plate and the electrical components are positioned in the widened gaps.

3. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, wherein the electrical contacts of the replacement chin are placed over the electrical contacts of the at least partially non-functioning electronic chip, and wherein the replacement chip has electrical components and the electrical components are positioned facing away from the endplate when the replacement chip is placed over the at least partially non-functioning electronic chip.

4. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, wherein the electrical contacts of the replacement chip are placed over the electrical contacts of the at least partially non-functioning electronic chip, and wherein the replacement chip has electrical components and the electrical components are positioned on a side of the toner hopper assembly when the replacement chip is placed over the at least partially non-functioning electronic chip.

5. The method of claim 4 wherein the electrical components are mounted on a printed circuit board and at least a portion of the printed circuit board is positioned over a hole on the side of the toner hopper assembly.

6. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, wherein the electrical contacts of the replacement chip are placed over the electrical contacts of the at least partially non-functioning electronic chip, and wherein the replacement chip has electrical components and the electrical components are positioned on a bottom of the toner hopper assembly when the replacement chip is placed over the at least partially non-functioning electronic chip.

7. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, wherein the toner hopper assembly is further modified by removing a portion of the at least partially non-functioning electronic chip through a contact window in the toner hopper assembly and the replacement chip is placed over the contact window.

8. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, further comprising the step of modifying the toner hopper assembly by forming a hole in the endplate, wherein electrical components of the replacement chip are positioned extending into the hole when the replacement chip is positioned over the at least partially non-functioning chip.

9. The method of claim 8 wherein the electrical contacts of the replacement chip are positioned over the electrical contacts of the at least partially non-functioning chip.

10. A method of modifying a toner hopper assembly for use in a toner cartridge comprising:

providing the toner hopper assembly having a generally cylindrical shape and an at least partially non-functioning electronic chip with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, wherein the toner hopper assembly is further modified by removing a section of the endplate and the contacts of the replacement chip are placed over the contacts of the at least partially non-functioning chip.

11. A method of modifying a toner hopper assembly for use in a toner cartridge comprising:

providing the toner hopper assembly having a generally cylindrical shape and an at least partially non-functioning electronic chin with electrical contacts disposed in an endplate section of the generally cylindrical shape; and modifying the toner hopper assembly by affixing a replacement chip to the toner hopper assembly to form a modified toner hopper assembly, wherein the replacement chip includes replacement electrical contacts which allow the replacement chip to communicate with a printer when the modified toner cartridge is installed in the printer, wherein the toner hopper assembly is further modified by removing a section of the endplate and a portion of the at least partially non-functioning electronic chip and the replacement chip is placed where the portion of the at least partially non-functioning chip was removed.

12. A modified toner cartridge comprising:

a toner hopper assembly having a generally cylindrical shape and an at least partially non-functioning electronic chip with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the electrical contacts of the replacement chin are placed over the electrical contacts of the at least partially non-functioning electronic chip when the replacement chip is affixed to the toner hopper assembly, wherein the replacement chip has electrical components and the electrical components are positioned in gaps which exist between the at least partially non-functioning electronic chip and the endplate when the replacement chip is placed over the at least partially non-functioning electronic chip.

13. The modified toner cartridge of claim 12 wherein the gaps are widened by removing a part of the end plate and the electrical components are positioned in the widened gaps.

14. A modified toner cartridge comprising:

a toner hopper assembly having a generally cylindrical shape and an at least partially non-functioning electronic chin with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the electrical contacts of the replacement chip are placed over the electrical contacts of the at least partially non-functioning electronic chip when the replacement chip is affixed to the toner hopper assembly, wherein the replacement chip has electrical components and the electrical components are positioned facing away from the endplate when the replacement chip is placed over the at least partially non-functioning electronic chip.

15. A modified toner cartridge comprising:

a toner hopper assembly having a generally cylindrical shape and an at least partially non-functioning electronic chin with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the electrical contacts of the replacement chip are placed over the electrical contacts of the at least partially non-functioning electronic chip when the replacement chip is affixed to the toner hopper assembly, wherein the replacement chip has electrical components and the electrical components are positioned on a side of the toner hopper assembly when the electrical contacts of the replacement chip are placed over the electrical contacts of the at least partially non-functioning electronic chip.

16. The modified toner cartridge of claim 15 wherein the electrical components are mounted on a printed circuit board and at least a portion of the printed circuit board is positioned over a hole on the side of the toner hopper assembly.

17. The modified toner cartridge of claim 15 wherein the electrical components are mounted on a printed circuit board, the printed circuit board affixed to a flange and at least a portion of the flange is positioned over a hole on the side of the toner hopper assembly.

18. A modified toner cartridge comprising:

a toner hopper assembly having a generally cylindrical share and an at least partially non-functioning electronic chip with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the electrical contacts of the replacement chip are placed over the electrical contacts of the at least partially non-functioning electronic chip when the replacement chip is affixed to the toner hopper assembly, wherein the replacement chip has electrical components and the electrical components are positioned on a bottom of the toner hopper assembly when the replacement chip is placed over the at least partially non-functioning electronic chip.

19. A modified toner cartridge comprising:

a toner hopper assembly having a generally cylindrical shape and an at least partially non-functioning electronic chip with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the toner hopper assembly is further modified by removing a portion of the at least partially non-functioning electronic chip through a contact window in the toner hopper assembly and the replacement chip is placed over the contact window.

20. A modified toner cartridge comprising:

a toner hopper assembly having a generally cylindrical shape and an at least partially non-functioning electronic chip with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the toner hopper assembly is further modified by forming a hole in the endplate, wherein electrical components of the replacement chip are positioned extending into the hole when the replacement chip is affixed to the toner hopper assembly.

21. The modified toner cartridge of claim 20 wherein the electrical contacts of the replacement chip are positioned over the electrical contacts of the at least partially non-functioning chip.

22. A modified toner cartridge comprising:

a toner hopper assembly having a generally cylindrical shape and an at least partially non-functioning electronic chin with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the toner hopper assembly is further modified by removing a section of the endplate and the electrical contacts of the replacement chip are placed over the electrical contacts of the at least partially non-functioning chip.

23. A modified toner cartridge comprising:

a toner hopper assembly having a generally cylindrical share and an at least partially non-functioning electronic chip with electrical contacts disposed in an endplate section of the generally cylindrical shape; and a replacement chip affixed to the toner hopper assembly wherein the replacement chip includes replacement electrical contacts which allow the replacement chip to communicate with a printer when the modified toner cartridge is installed in a printer, wherein the toner hopper assembly is further modified by removing a section of the endplate and a portion of the at least partially non-functioning electronic chip and the replacement chip is placed where the portion of the at least partially non-functioning chip was removed.

* * * * *